US007878621B2

(12) United States Patent
Hiraki et al.

(10) Patent No.: US 7,878,621 B2
(45) Date of Patent: Feb. 1, 2011

(54) INK-JET PRINTER AND METHOD OF SUCKING INK FROM AIR-DISCHARGE CAP OF INK-JET PRINTER

(75) Inventors: Nobuo Hiraki, Nagoya (JP); Takaichiro Umeda, Nagoya (JP); Noritsugu Ito, Tokoname (JP); Hikaru Kaga, Aisai (JP); Tatsuya Shindo, Nagoya (JP); Wataru Sugiyama, Aichi-ken (JP); Katsunori Nishida, Aichi-ken (JP); Tomohisa Higuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 900 days.

(21) Appl. No.: 11/763,697

(22) Filed: Jun. 15, 2007

(65) Prior Publication Data

US 2007/0296754 A1 Dec. 27, 2007

(30) Foreign Application Priority Data

Jun. 15, 2006 (JP) ..... 2006-166419
Jun. 15, 2006 (JP) ..... 2006-166420

(51) Int. Cl.
*B41J 2/165* (2006.01)

(52) U.S. Cl. ..... 347/30; 347/29

(58) Field of Classification Search ..... 347/29, 347/30, 32, 84, 85
See application file for complete search history.

(56) References Cited

U.S. PATENT DOCUMENTS 6,517,189 B2 * 2/2003 Ogawa et al. ..... 347/35
6,830,311 B2 * 12/2004 Fukasawa et al. ..... 347/29
7,131,720 B2 * 11/2006 Mizuno et al. ..... 347/92
7,150,519 B2 * 12/2006 Kono et al. ..... 347/85
2005/0195240 A1 9/2005 Hiraki
2005/0195246 A1 9/2005 Ogawa

FOREIGN PATENT DOCUMENTS

JP 2005246928 A 9/2005
JP 2005246929 A 9/2005

* cited by examiner

*Primary Examiner*—Anh T. N. Vo
(74) *Attorney, Agent, or Firm*—Baker Botts L.L.P.

(57) ABSTRACT

An ink-jet printer including a carriage carrying recording heads, air collecting chambers, and discharging passages communicating with the respective air collecting chambers; opening and closing valves provided in the respective discharging passages; opening and closing bars which open and close the respective valves; an air discharge cap which has a bottom wall, a side wall, and a suction hole, wherein an upper end surface of the side wall is closely contactable with a lower surface of the carriage to cover respective openings of the discharging passages; a suction device which sucks air through the suction hole; and an air-flow generating device which causes an air flow inlet to open at a position distant from the suction hole, so that when air is sucked through the suction hole, the air flows from the air flow inlet toward the suction hole. An ink sucking method is also provided.

19 Claims, 22 Drawing Sheets

INK-JET PRINTER AND METHOD OF SUCKING INK FROM AIR-DISCHARGE CAP OF INK-JET PRINTER

The present application is based on Japanese Patent Applications No. 2006-166419 and No. 2006-166420 each filed on Jun. 15, 2006, the contents of which are incorporated herein by reference.

BACKGROUND OF THE INVENTION

1. Field of the Invention

The present invention relates to an ink-jet printer that ejects, from nozzles thereof, droplets of ink and thereby records an image on a recording medium, and particularly to such an ink-jet printer that can remove air bubbles produced in one or more ink-flow passages and thereby maintain a high recording quality. The present invention also relates to a method of sucking ink that has been discharged into an air-discharge cap of an ink-jet printer when air bubbles are removed through the cap, the ink-jet printer additionally including one or more ink ejection portions (or one or more recording heads) that eject, from nozzles thereof, droplets of ink, and one or more ink-flow passages which supply the ink to the ink-ejection portions and in which air bubbles are produced or separated from the ink.

2. Discussion of Related Art

There has been proposed an ink-jet printer including a housing, a plurality of ink ejection portions each of which ejects, from nozzles thereof, droplets of ink, a carriage that carries the ink ejection portions and is movable relative to the housing, a plurality of ink tanks that store different sorts of inks to be supplied to the ink ejection portions, and a plurality of ink flow passages that supply the different sorts of inks from the ink tanks to the ink ejection portions. In the case where the ink tanks store respective sorts of inks having different colors and the ink ejection portions eject droplets of those inks supplied from the ink tanks via the ink flow passages, the ink-jet printer can record a full-color image.

For example, Japanese Patent Application Publication No. 2005-246928 discloses an ink-jet printer including a carriage, a plurality of ink flow passages, a plurality of air-bubble collecting chambers which are provided on the carriage and each of which collects air bubbles produced in a corresponding one of the ink flow passages, a plurality of discharging passages that are provided on the carriage and communicate with the air-bubble collecting chambers, respectively, a plurality of normally-closed opening and closing valves that are respectively provided in the discharging passages, a housing, a plurality of bar-like opening and closing members which are supported by the housing and each of which opens and closes a corresponding one of the opening and closing valves, and an air-discharge cap which is supported by the housing, through which the opening and closing members slideably extend, and which can be closely contacted with the carriage so as to cover respective outlets of the discharging passages and define an air-tight space communicating with the outlets.

In the above-indicated ink-jet printer, the air bubbles produced in the ink flow passages are temporarily collected by the air-bubble collecting chambers and, when the opening and closing valves are opened by the opening and closing members, the air bubbles are discharged into the air-tight space defined by the air-discharge cap. Thus, the air bubbles produced in the ink flow passages can be efficiently removed and accordingly a high recording quality of the ink-jet printer can be maintained. In addition, since the air bubbles collected by the air-bubble collecting chambers are not directly discharged into the atmosphere but are discharged into the air-tight space defined by the air-discharge cap, the ambient air can be prevented from entering the air-bubble collecting chambers. Therefore, the air bubbles produced in the ink flow passages can be more efficiently removed from the ink-jet printer.

When the air bubbles are removed in the above-described manner, respective certain amounts of inks present in the ink flow passages are discharged with the air bubbles into the air-discharge cap. Hence, the above-indicated application publication proposes to apply, after the removal of the air bubbles, suction to the air-discharge cap so as to suck and remove the inks present in the cap.

However, ink has a certain degree of viscosity and accordingly the ink adhered to the air-discharge cap may not be removed by just applying suction thereto.

In addition, the definition or formation of the air-tight space needs to dispose the air-discharge cap such that the cap is movable relative to the carriage and also needs to apply a biasing force to move the cap toward the carriage. In this case, since the air-discharge cap can be brought into pressed contact with the carriage, the cap can be moved away from the carriage against the biasing force, and the air tightness of the air-tight space can be assured at a high reliability.

However, the arrangement needed to support, with a frame-side member (or a housing), the air-discharge cap such that the cap is movable against the biasing force may be complicated and/or increased in size.

SUMMARY OF THE INVENTION

In the above-identified background, the present invention has been developed. It is therefore an object of the present invention to solve at least one of the above-identified problems. It is another object of the present invention to provide an ink-jet printer that enjoys a simple construction and/or a reduced size of an arrangement around an air-discharge cap thereof. It is another object of the present invention to provide a method of sucking ink from an air discharge cap of an ink-jet printer and thereby preventing the ink from remaining in the cap.

According to a first aspect of the present invention, there is provided an ink-jet printer, comprising a housing; a plurality of recording heads each of which has at least one nozzle opening in a lower surface thereof and ejects, from the at least one nozzle, droplets of ink so as to record an image on a recording medium; a carriage which is movable in the housing and which carries the plurality of recording heads; a plurality of ink tanks which store at least one sort of ink to be supplied to the plurality of recording heads; a plurality of ink flow passages which supply the at least one sort of ink from the plurality of ink tanks to the plurality of recording heads, respectively; a plurality of air collecting chambers which are provided on the carriage and each of which collects air bubbles produced in a corresponding one of the plurality of ink flow passages; a plurality of discharging passages which are provided on the carriage and each of which communicates with a corresponding one of the plurality of air collecting chambers; a plurality of first opening and closing valves each of which is normally closed and is provided in a corresponding one of the plurality of discharging passages such that the plurality of first opening and closing valves are arranged in a first direction; a plurality of opening and closing bars which are supported by the housing such that the plurality of opening and closing bars are arranged in a second direction parallel to the first direction, and each of which opens and closes a corresponding one of the plurality of first opening and closing valves; an air-tight-space defining device including an air-discharge cap which has a bottom wall, a side wall projecting upward from a periphery of the bottom wall, and a suction hole, wherein the air-tight-space defining device is supported by the housing such that the each of the opening and closing bars air-tightly extends through a thickness of the bottom wall of the air-discharge cap and is movable relative to the air-discharge cap, and such that an upper end surface of the side wall of the air-discharge cap is closely contactable with a lower surface of the carriage to cover respective openings of the plurality of discharging passages and define an air-tight space communicating with each of the respective openings; a suction device which sucks air through the suction hole of the air-discharge cap; and an air-flow generating device which causes an air flow inlet to open at a position distant from the suction hole in a third direction having a first component parallel to the bottom wall of the air-discharge cap, so that when the suction device sucks the air through the suction hole, the air flows from the air flow inlet toward the suction hole in a fourth direction having a second component opposite to the first component of the third direction.

In the present ink-jet printer, the air-discharge cap has the bottom wall, the side wall projecting upward from the periphery of the bottom wall and the suction hole, and the air-flow generating device causes the air flow inlet to open at a position distant from the suction hole in the third direction having the first component parallel to the bottom wall of the air-discharge cap, so that when the suction device sucks the air through the suction hole, the air flows from the air flow inlet toward the suction hole in the fourth direction having the second component opposite to the first component of the third direction. Thus, the arrangement around the air-discharge cap can be simplified and reduced in size. For example, the air-flow generating device may comprise at least one projecting portion that projects from at least one side surface of the air-tight-space defining device, at least one hook portion having at least one fitting hole within which the at least one projecting portion is movable, and a biasing device that biases the air-tight-space defining device toward the carriage. In this particular case, when a moving device moves the hook portion toward the carriage, the air-discharge cap can be closely contacted with the carriage. Thus, in this case, the projecting portion of the air-tight-space defining device and the fitting hole of the hook portion cooperate with each other to assure that the cap is movable relative to the carriage. That is, the engagement of the projecting portion of the air-tight-space defining device and the fitting hole of the hook portion is utilized to support the air-discharge cap. Thus, the arrangement around the air-discharge cap can be simplified and reduced in size.

According to a second aspect of the present invention, there is provided a method of sucking at least one sort of ink which has been discharged into an air-discharge cap of an ink-jet printer upon opening of a plurality of opening and closing valves of the ink-jet printer, the ink-jet printer additionally including a housing, a plurality of recording heads each of which has at least one nozzle and ejects, from the at least one nozzle, droplets of the at least one sort of ink, a carriage which is movable relative to the housing and which carries the plurality of recording heads, a plurality of ink tanks which stores the at least one sort of ink to be supplied to the plurality of recording heads; a plurality of ink flow passages which supply the at least one sort of ink from the plurality of ink tanks to the plurality of recording heads, respectively; a plurality of air collecting chambers which are provided on the carriage and each of which collects air bubbles produced in a corresponding one of the plurality of ink flow passages; a plurality of discharging passages which are provided on the carriage, each of which communicates with a corresponding one of the plurality of air collecting chambers, and in each of which a corresponding one of the plurality of opening and closing valves each of which is normally closed is provided; and a plurality of opening and closing bars which are supported by the housing such that each of the opening and closing bars air-tightly extends through a thickness of the air-discharge cap, and each of which opens and closes a corresponding one of the plurality of opening and closing valves, the air-discharge cap being supported by the housing such that the air-discharge cap is closely contactable with the carriage to cover respective openings of the plurality of discharging passages and define an air-tight space communicating with each of the respective openings, the method comprising inclining, from a state in which the air-tight space is defined, the air-discharge cap relative to the carriage to form a gap between the carriage and a first portion of the air-discharge cap, and sucking, from a second portion of the air-discharge cap that is opposite to the first portion thereof the at least one sort of ink discharged into the air-discharge cap.

In the present method, first, the air-discharge cap is closely contacted with the carriage so as to define the air-tight space, subsequently the air-discharge cap is inclined to provide or form the gap between the cap and the carriage, and then the ink present in the cap is sucked from an ink-suction portion of the cap that is opposite to the gap. Therefore, air is caused to flow from the gap between the cap and the carriage toward the ink suction portion, and the ink is conveyed by the air flow to the ink suction portion. Thus, in the present method, the ink discharged into the air-discharge cap can be efficiently sucked and accordingly the ink can be effectively prevented from remaining in the cap.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
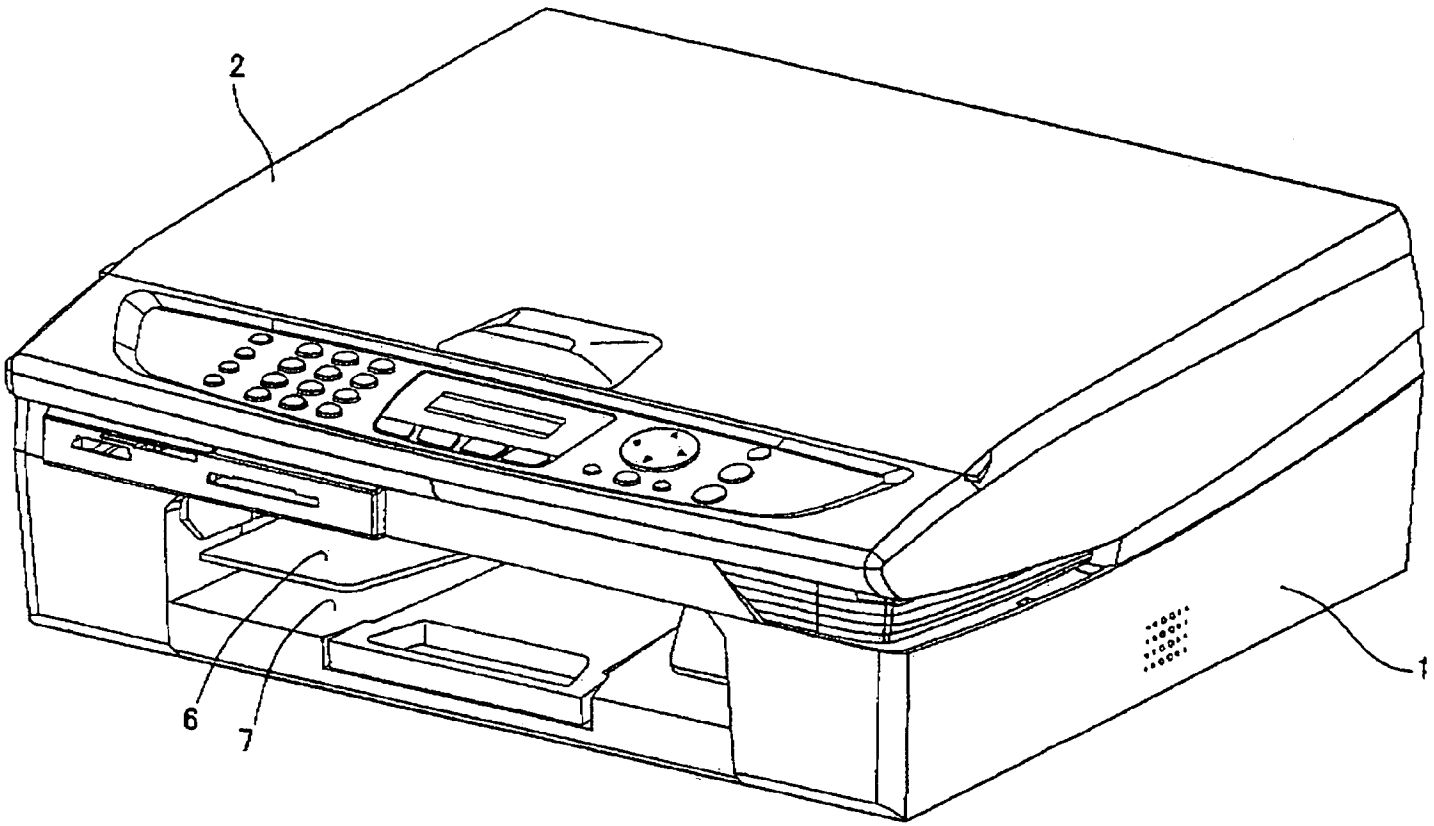
FIG. 1 is a perspective new showing an external construction of an ink-jet printer to which the present invention is applied.
Figure 2:
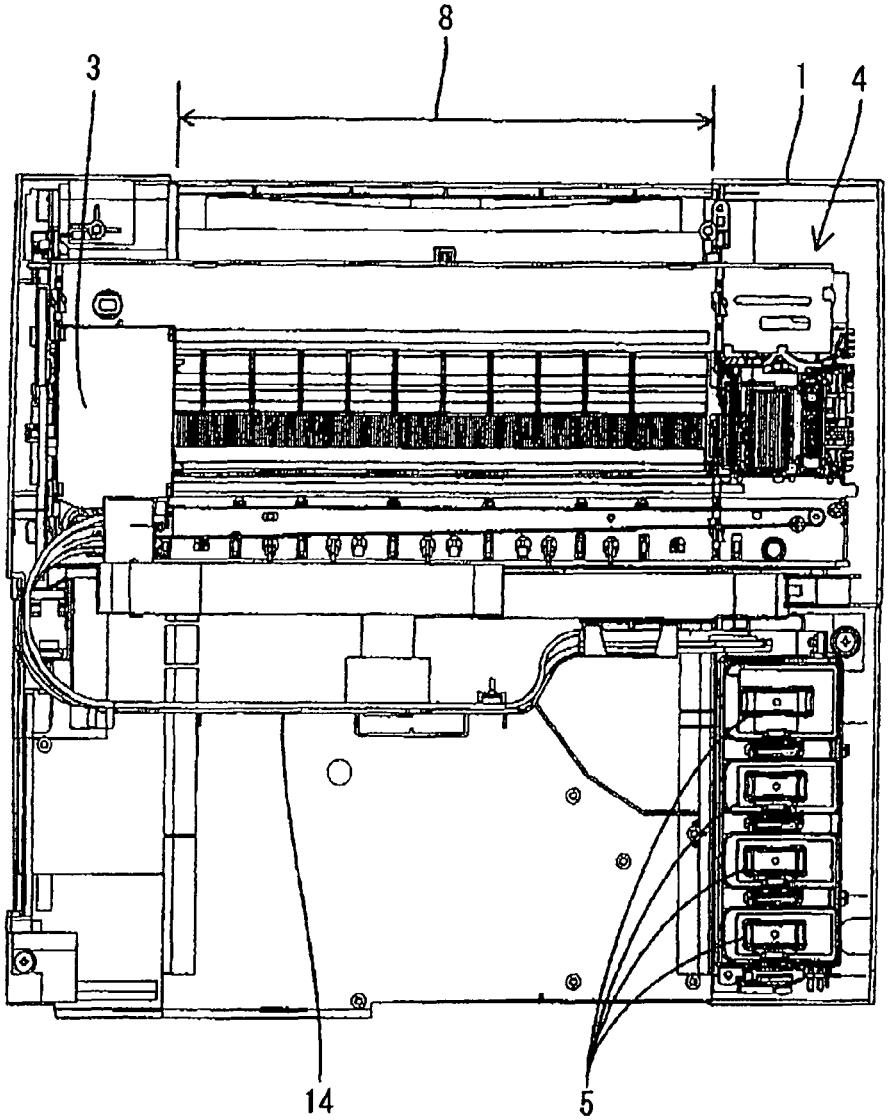
FIG. 2 is a plan view showing an internal construction of the printer.

Hereinafter, there will be described preferred embodiments of the present invention by reference to the drawings. A first embodiment of the present invention relates to an ink-jet printer having a printer function, a scanner function, and a copier function. As shown in FIGS. 1 and 2, the ink-jet printer includes a main frame or housing 1, and an original-image reading device 2 that is provided above the housing 1 and serves for the scanner function and the copier function. Below the original-image reading device 2, the housing 1 accommodates a recording-related carriage 3, a maintenance unit 4 that recovers four recording heads 10, described later, from clogging of nozzles thereof, and four ink tanks (i.e., four ink cartridges) 5 that respectively supply four sorts of inks to the four recording heads 10. In a front portion of the housing 1, there are provided a sheet-discharge tray 6 and a sheet-supply tray 7. The carriage 3 reciprocates in opposite directions, i.e., leftward and rightward directions in FIG. 2. Reference numeral 8 designates a recording area 8 that ranges from a left-hand end of a path of movement of the carriage 3, to a position near a right-hand end of the movement path. The right-hand end of the movement path corresponds to a maintenance position (i.e., an origin position or a home position) of the carriage 3 where the maintenance unit 4 is provided. The four ink tanks 5 that store black, cyan, magenta, and yellow inks, respectively, are provided in front of the maintenance position, such that the four tanks 6 are arranged in an array.

<Carriage 3 & Supplying of Inks to Carriage 3>

Figure 3:
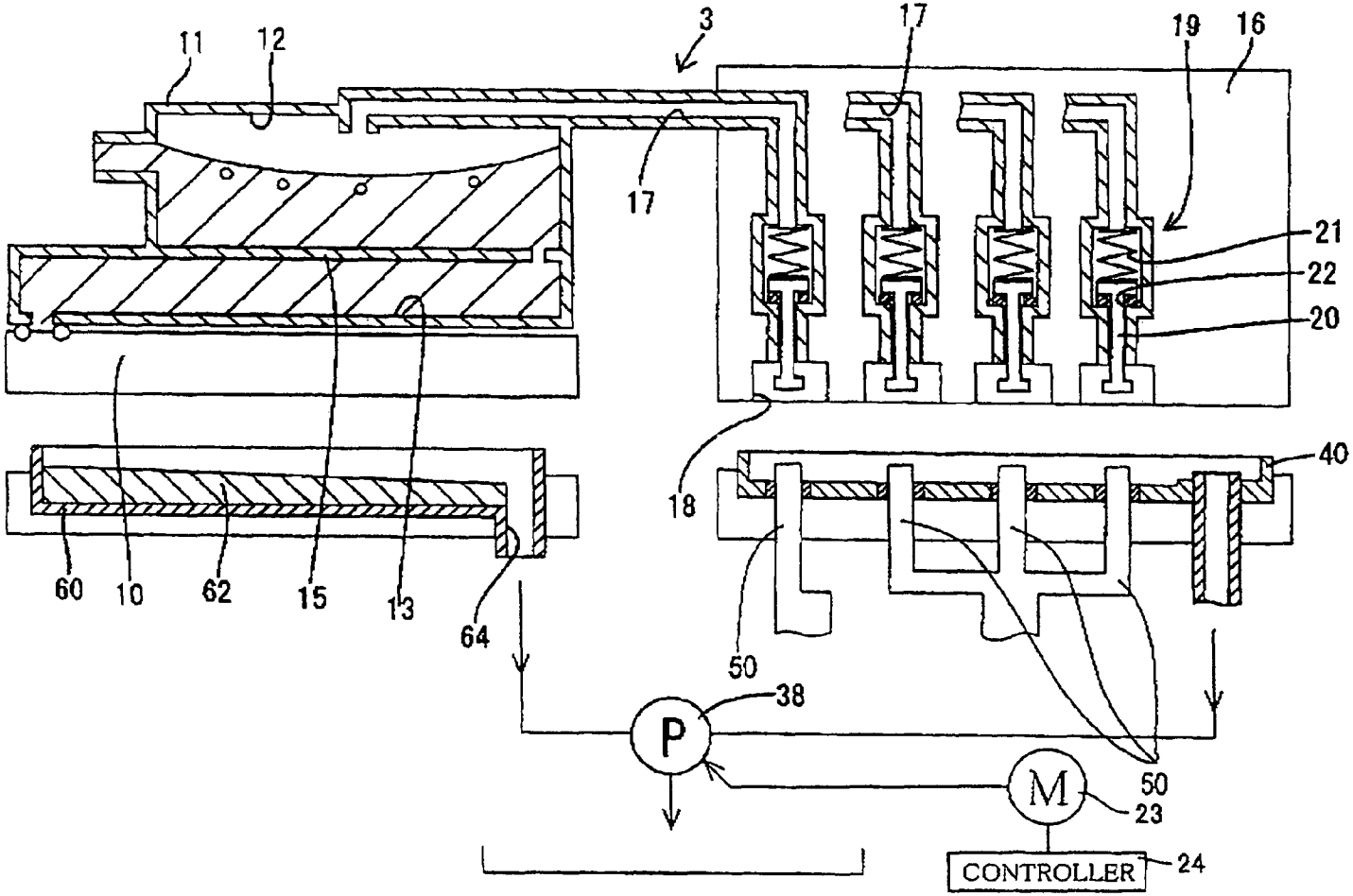
FIG. 3 is an illustrative cross-sectional view of a carriage of the printer.
Figure 4:
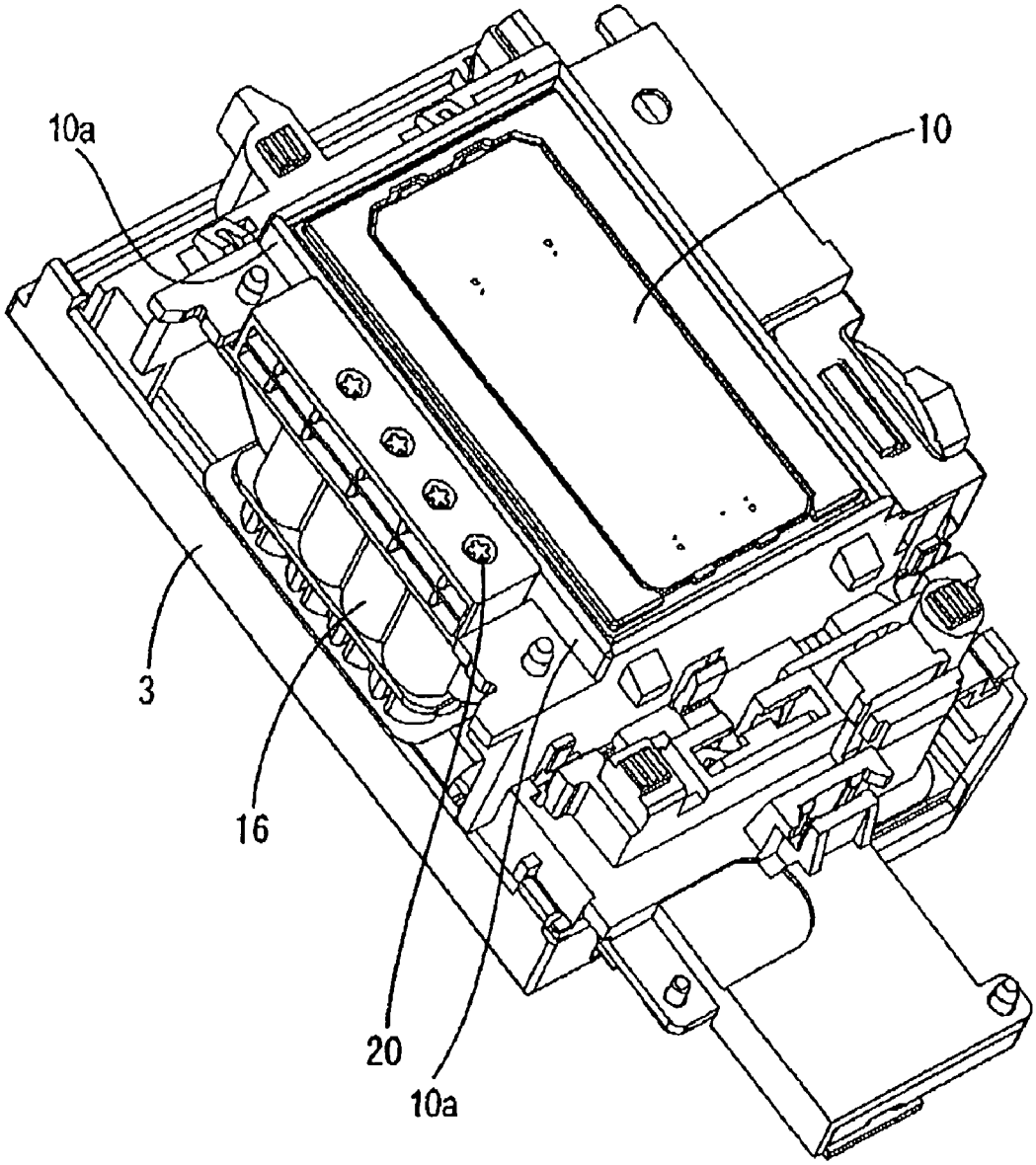
FIG. 4 is a perspective bottom view of the carriage.

As shown in FIGS. 3 and 4, the carriage 3 includes four recording heads 10, each as an ink ejecting portion, which correspond to the black, cyan, magenta, and yellow inks, respectively, and each of which has a plurality of ink ejection nozzles opening in a lower surface thereof. While the carriage 3 is moved in the recording area 8, the four recording heads 10 eject droplets of the inks in a downward direction so as to record or print an image on a recording or printing sheet as a recording medium.

Above each of the four recording heads 10, a buffer tank 11 is provided. Each of the four buffer tanks 11 includes, as an upper portion of an inner space or chamber thereof, an air-bubble collecting chamber 12, and additionally includes, as a lower portion of the inner chamber thereof an ink-flow chamber 11. The four inks are supplied from the four ink tanks 5 to the respective air-bubble collecting chambers 12 of the four buffer tanks 11 via respective flexible tubes 14 as ink flow passages (FIG. 2). The ink supplied to each air-bubble collecting chamber 12 flows into the corresponding ink-flow chamber 13 via a filter 15, and further flows into the corresponding recording head 10. While the ink passes through the filter 15, air bubbles present in the ink are separated and are collected in the air-bubble collecting chamber 12. The air bubbles are produced while the inks flow in the flexible tubes 14.

The carriage 3 further includes a bubble case 16 that is provided on a right-hand side of the four recording heads 10 in FIG. 2, i.e., a left-hand side of the heads 10 in FIG. 4. Four discharging passages 17 are connected, at respective one ends thereof, to respective ceiling walls of the respective air-bubble collecting chambers 12 of the four buffer tanks 11, so as to communicate with the respective collecting chambers 12, and respective other ends of the four discharging passages 17 open, as respective discharge outlets 18 thereof, in a lower surface of the bubble case 16, such that the four discharge outlets 18 are arranged in an array in frontward and rearward directions perpendicular to the directions of reciprocation of the carriage 38. In the bubble case 16, each of the four discharging passages 17 extends in a vertical direction, and a normally closed, opening and closing valve 19 is accommodated by the vertically extending portion of the each discharging passage 17. Each of the four opening and closing valves 19 includes a valve member 20 that is elongate in the vertical direction, and a spring 21 that normally biases the valve member 20 in a direction to close an opening 22 and thereby maintain the each valve 19 at a closed state or position thereof. However, when the valve member 20 is moved in an upward direction against the biasing force of the spring 21, the each valve 19 is opened, i.e., is placed in an open state or position thereof. The carriage 3 has four air-discharge paths (described in detail, later) each of which begins with the air-bubble collecting chamber 12 of the corresponding buffer tank 11 and ends with the discharge outlet 18 of the corresponding discharging passage 17. The three air-discharge paths corresponding to the three color inks, i.e., the cyan, yellow, and magenta inks have a same resistance to flowing of air therethrough, and the air-discharge path corresponding to the black ink has a resistance to flowing of air therethrough that is smaller than those of the three air-discharge paths.

When the carriage 3 is moved within the reciprocation or movement path thereof the carriage 3 can be stopped at each of the origin position as the right-hand end of the movement path, a discharged-ink suction position that is located on a left-hand side of, and adjacent to, the origin position and is located on a right-hand side of a wiper 90 (FIG. 7), and a wiping-end position that is located on a left-hand side of, and adjacent to, the discharged-ink suction position.

<Transmission of Driving Force to Maintenance Unit 4>

Figure 5:
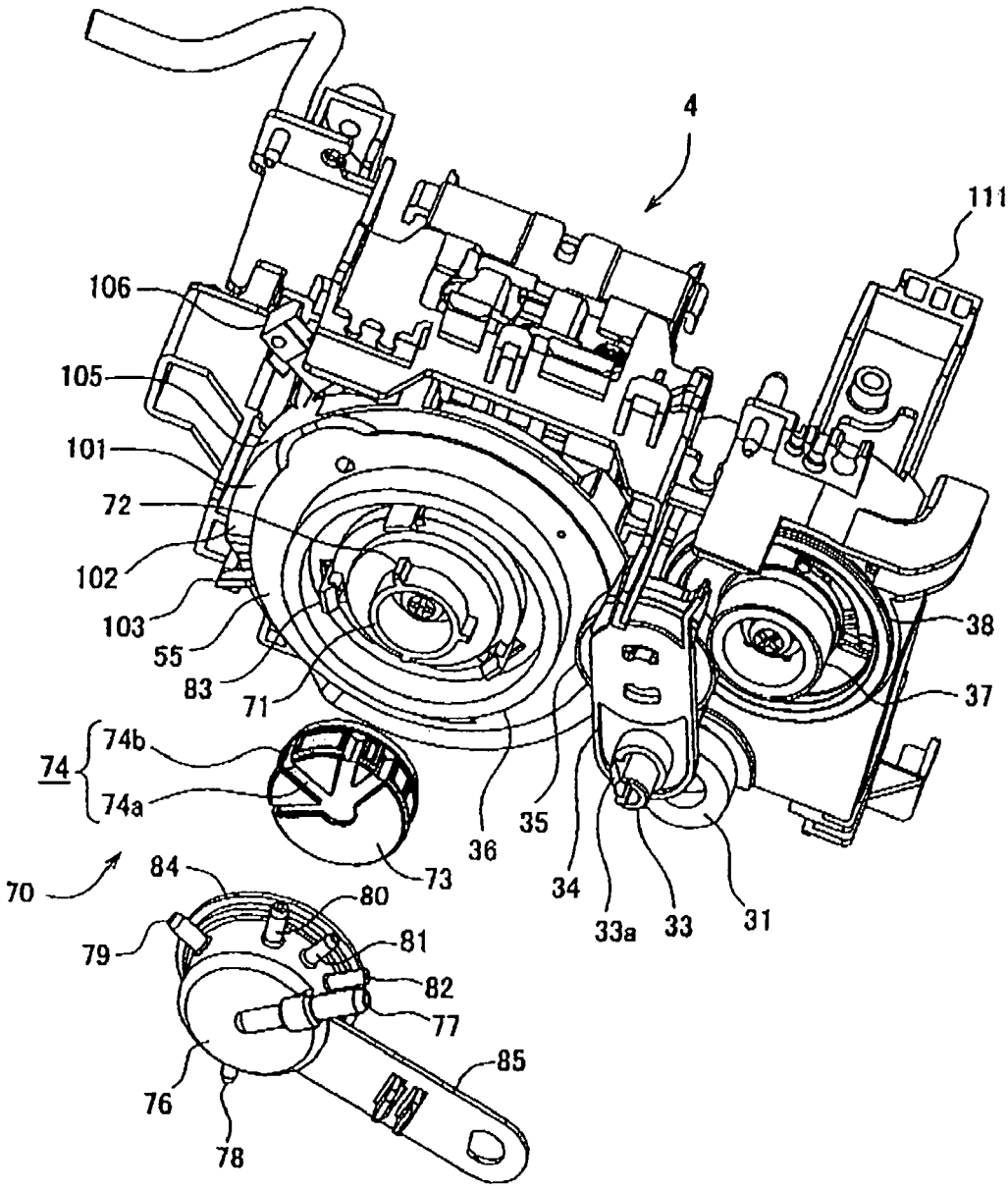
FIG. 5 is a partly exploded, perspective bottom view of a maintenance unit of the printer.
Figure 6:
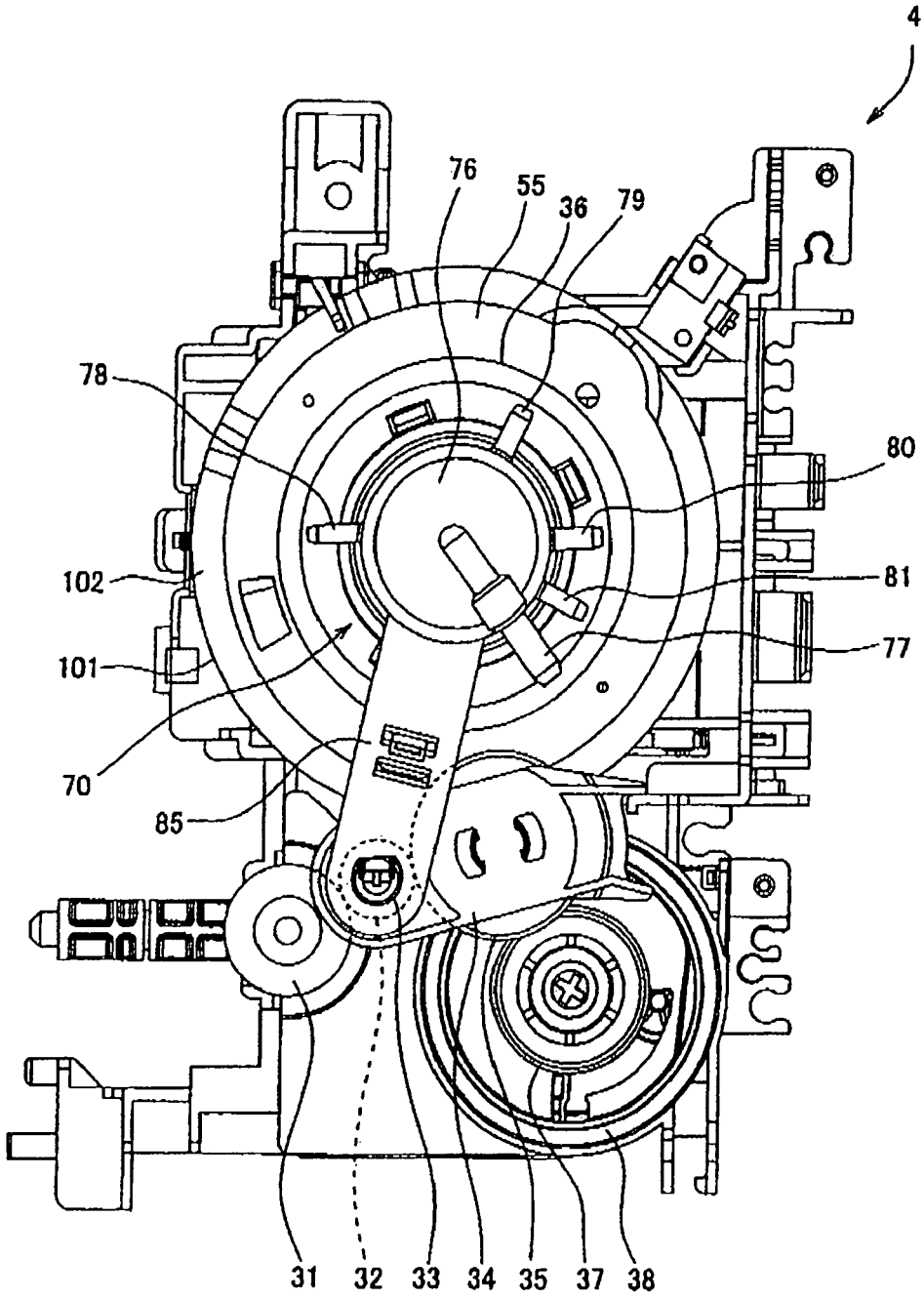
FIG. 6 is a bottom view of the maintenance device.

As shown in FIGS. 3, 5 and 6, the maintenance 4 includes a gear 31, and a sun gear 32 that receives a driving force via the gear 31 from an electric motor 23 (FIG. 3) that is for rotating a sheet-supply roller (not shown) to supply each recording sheet from the sheet-supply tray 7. The sun gear 32 has an axis portion 33 to which one end portion of a revolving arm 34 is attached such that the one end portion is rotatable relative to the axis portion 33. A planetary gear 35 that is engaged with the sun gear 32 is attached to the other end portion of the revolving arm 34 such that the planetary gear 35 is rotatable relative to the other end portion. In front of the planetary gear 35, a disc-like cam 55 is supported by a maintenance frame 111, such that the disc-like cam 55 is rotatable about an axis line extending in the vertical direction parallel to the respective axis lines of the sun gear 32 and the planetary gear 35. The cam 55 has, as an integral portion thereof, a follower gear 36 at a height position where the planetary gear 35 is provided. The cam 65 will be described in detail, later. The maintenance frame 111 is fixed to the housing 1.

In rear of the planetary gear 35, a pump gear 37 is supported by the maintenance frame 111, at the height position where the planetary gear 35 is provided, such that the pump gear 37 is rotatable about a vertical axis line. When the pump gear 37 is rotated, a rotary-type pump 38 is driven to apply suction (i.e., a negative pressure) to an object. The rotary-type pump 38 and the electric motor 23 cooperate with each other to constitute a suction device.

Figure 16:
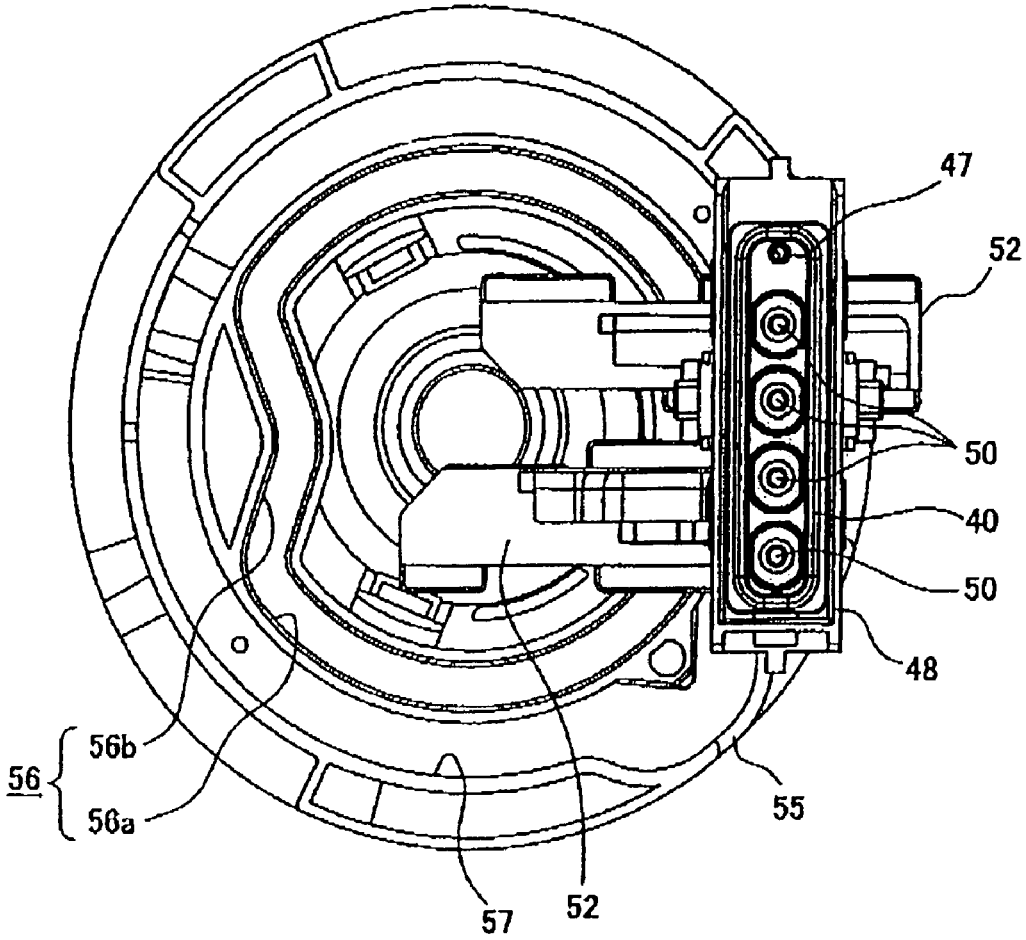
FIG. 16 is a plan view showing respective constructions of a cam and sliders.

When the sun gear 32 is rotated counterclockwise in the bottom view of FIG. 6, the planetary gear 35 is revolved counterclockwise about the sun gear 32, so that the planetary gear 35 is engaged with the follower gear 36 of the cam 55 and the cam 55 is rotated counterclockwise in the bottom view of FIG. 6, i.e., clockwise in the top view of FIG. 16. Conversely, when the sun gear 32 is rotated clockwise in the bottom view of FIG. 6, the planetary gear 35 is revolved clockwise about the sun gear 32, so that the planetary gear 35 is engaged with the pump gear 37 and the pump 38 is driven or rotated to perform the sucking operation. Thus, the cam 55 is rotated in one direction only, i.e., counterclockwise in FIG. 6, i.e., clockwise in FIG. 16.

<Air-Discharge Cap 40 of Maintenance Unit 4>

Figure 7:
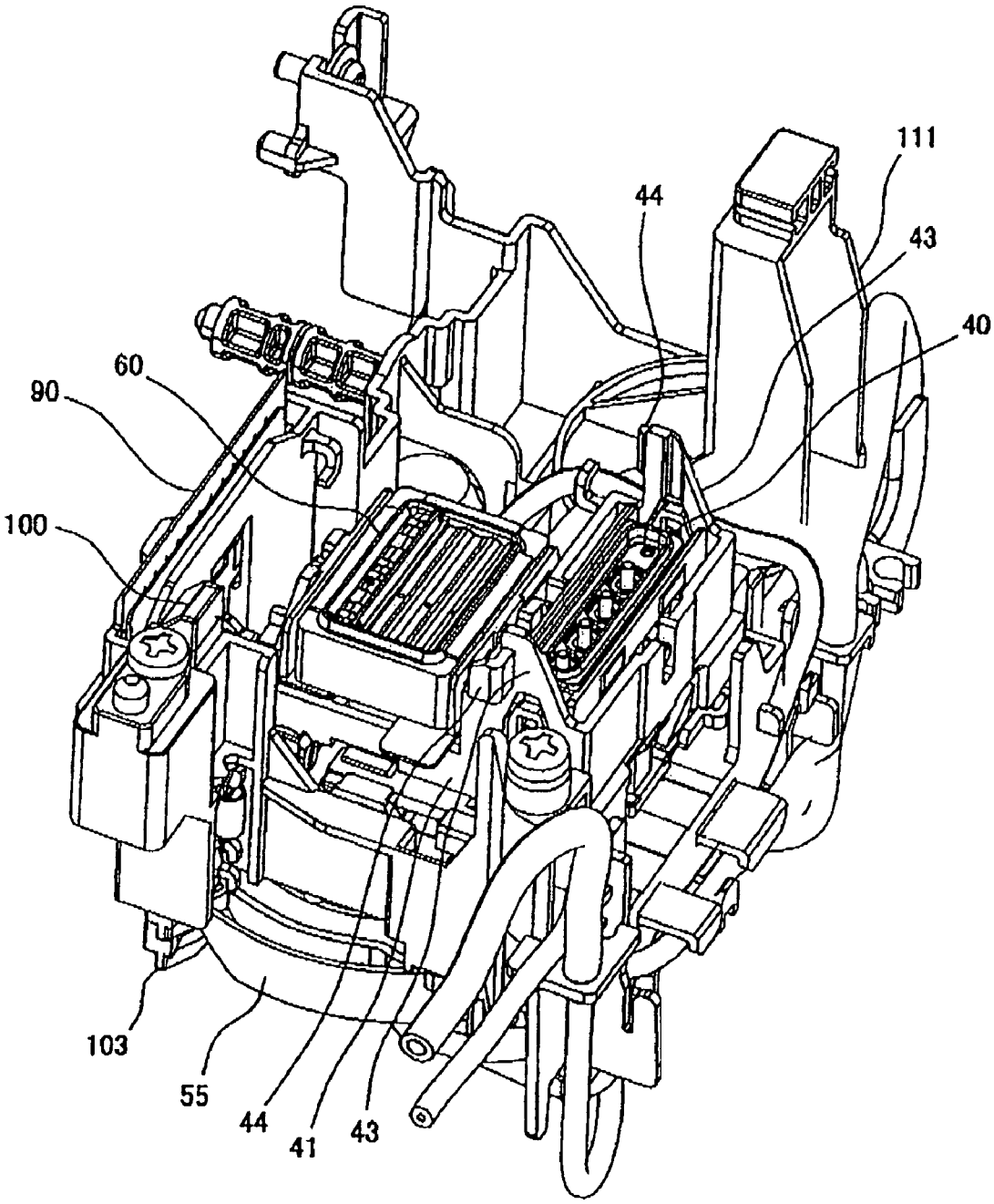
FIG. 7 is a perspective view of the maintenance device.
Figure 8:
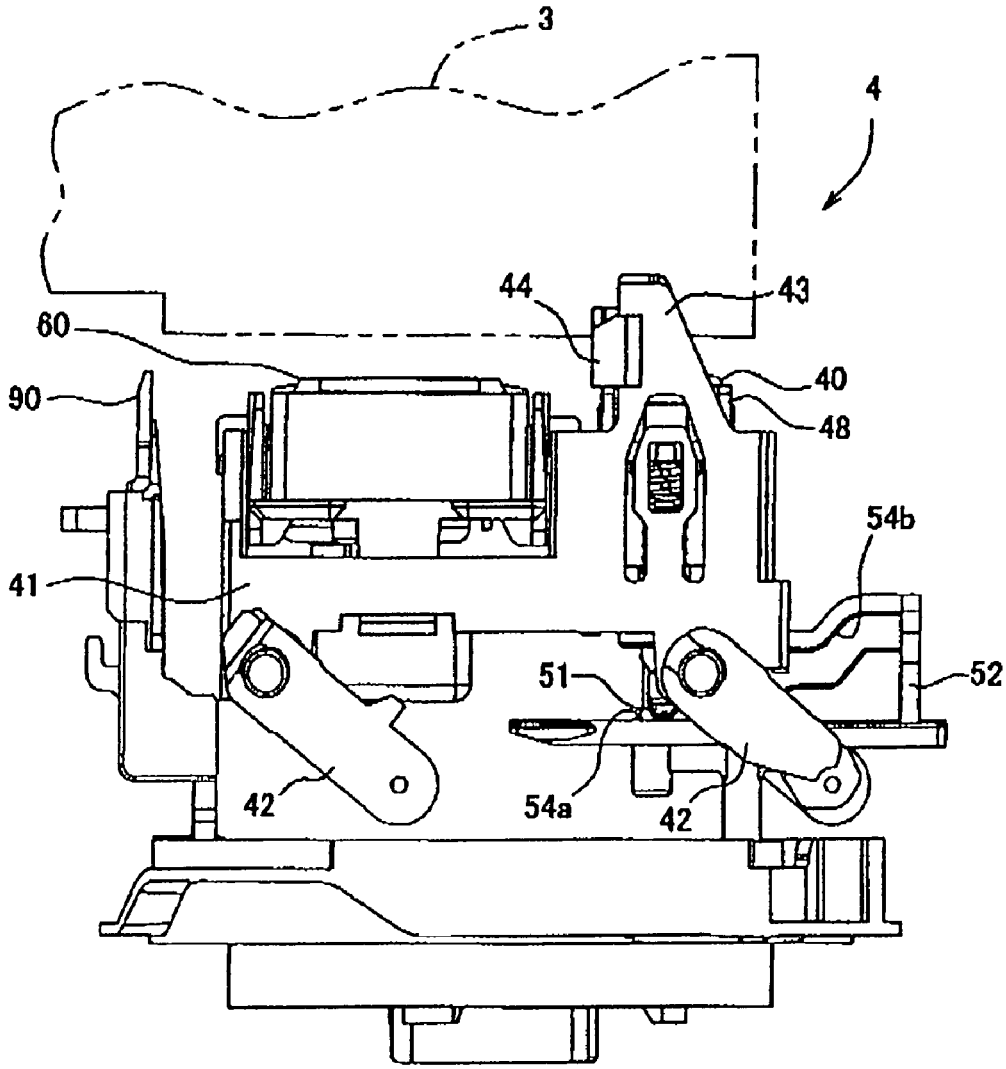
FIG. 8 is an illustrative front view showing a state in which a lift member is positioned at a waiting position, opening and closing members are positioned at respective valve closing positions, and a wiper is positioned at a retracted position.
Figure 9:
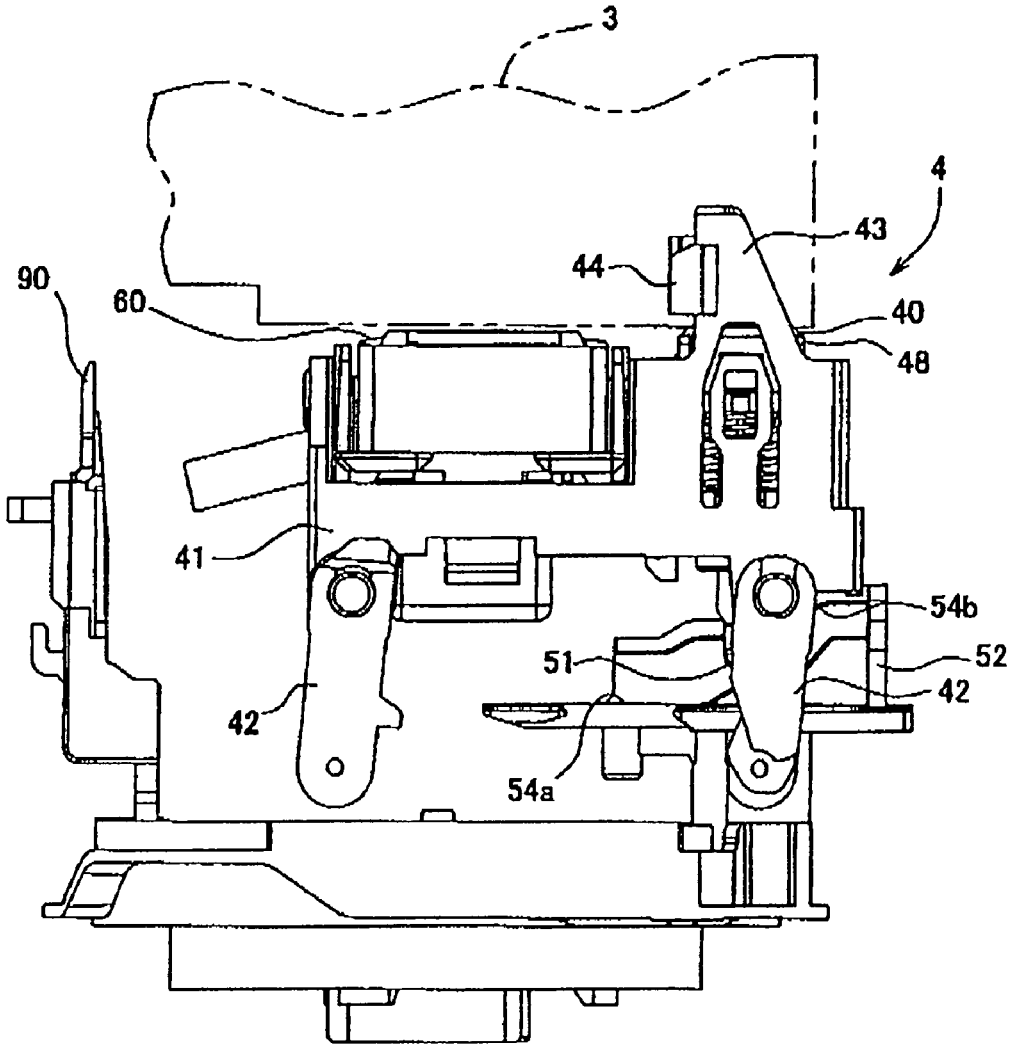
FIG. 9 is an illustrative front view showing a state in which the carriage is positioned at an origin position and the opening and closing members are positioned at the respective valve closing positions.

As shown in FIG. 7, the maintenance frame 111 supports a lift member 41 as a portion of a moving device, such that the lift member 41 is movable relative to the frame 111. As shown in FIGS. 8 and 9, the moving device additionally includes a left-hand pair of parallel links 42 (only one link 42 is shown) and a right-hand pair of parallel links 42 (only one link 42 is shown) that have a same length and cooperate with each other to provide a four-link mechanism that can translate, in the leftward and rightward directions, the lift member 41 along an arcuate path between a waiting position and a close-contact position. FIG. 8 shows a state in which the lift member 41 is positioned at the waiting position, i.e., the left-hand and lower position; and FIG. 9 shows a state in which the lift member 41 is positioned at the close-contact position, i.e., the right-hand and upper position. The moving device further includes a returning spring (not shown) that biases the lift member 41 in a direction from the close-contact position (i.e., the right-hand position) toward the waiting position (i.e., the left-hand position).

The lift member 41 has, as integral portions thereof, two extending portions 43 that extend upward from front and rear ends of a right-hand end portion of the lift member 41, respectively. Each of the two extending portions 43 supports, at an upper end thereof, an engaging plate 44 that has an L-shaped configuration in its plane view and can engage a corresponding one of two end surfaces 10*a* (FIG. 4) of the right-hand one of the four recording heads 10. Therefore, when the carriage 38 is moved in the rightward direction from the recording area 8 toward the origin position (i.e., the maintenance position), the right-hand recording head 10 engages the two engaging plates 44 of the lift member 41, immediately before the carriage 38 reaches the origin position, and then the recording head 10 continues to push the plates 44 till the head 10 reaches the origin position. Thus, the lift member 41 is moved from the waiting position to the close-contact position, against the biasing force of the returning spring.

Figure 10:
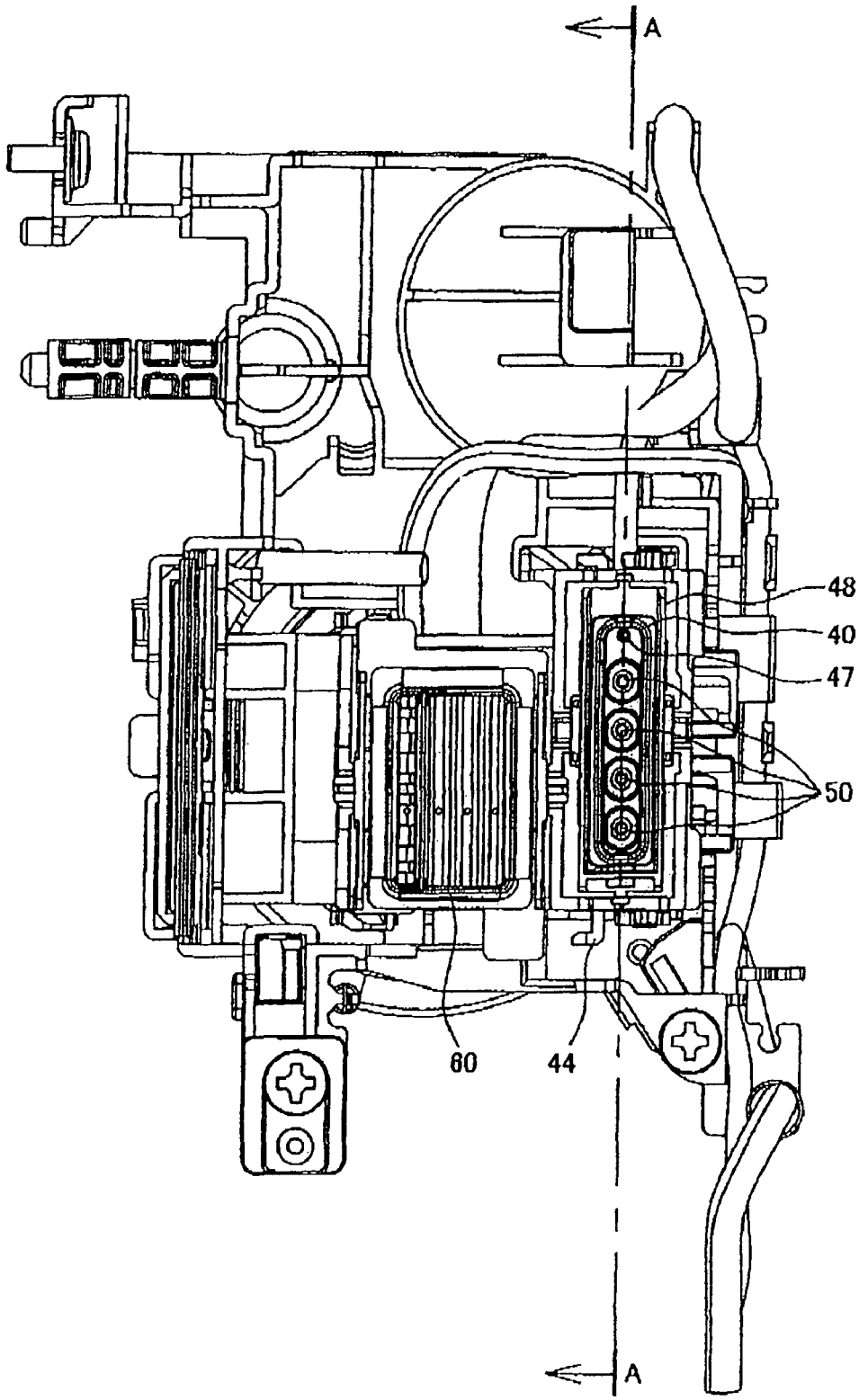
FIG. 10 is a plan view of the maintenance unit.
Figure 11:
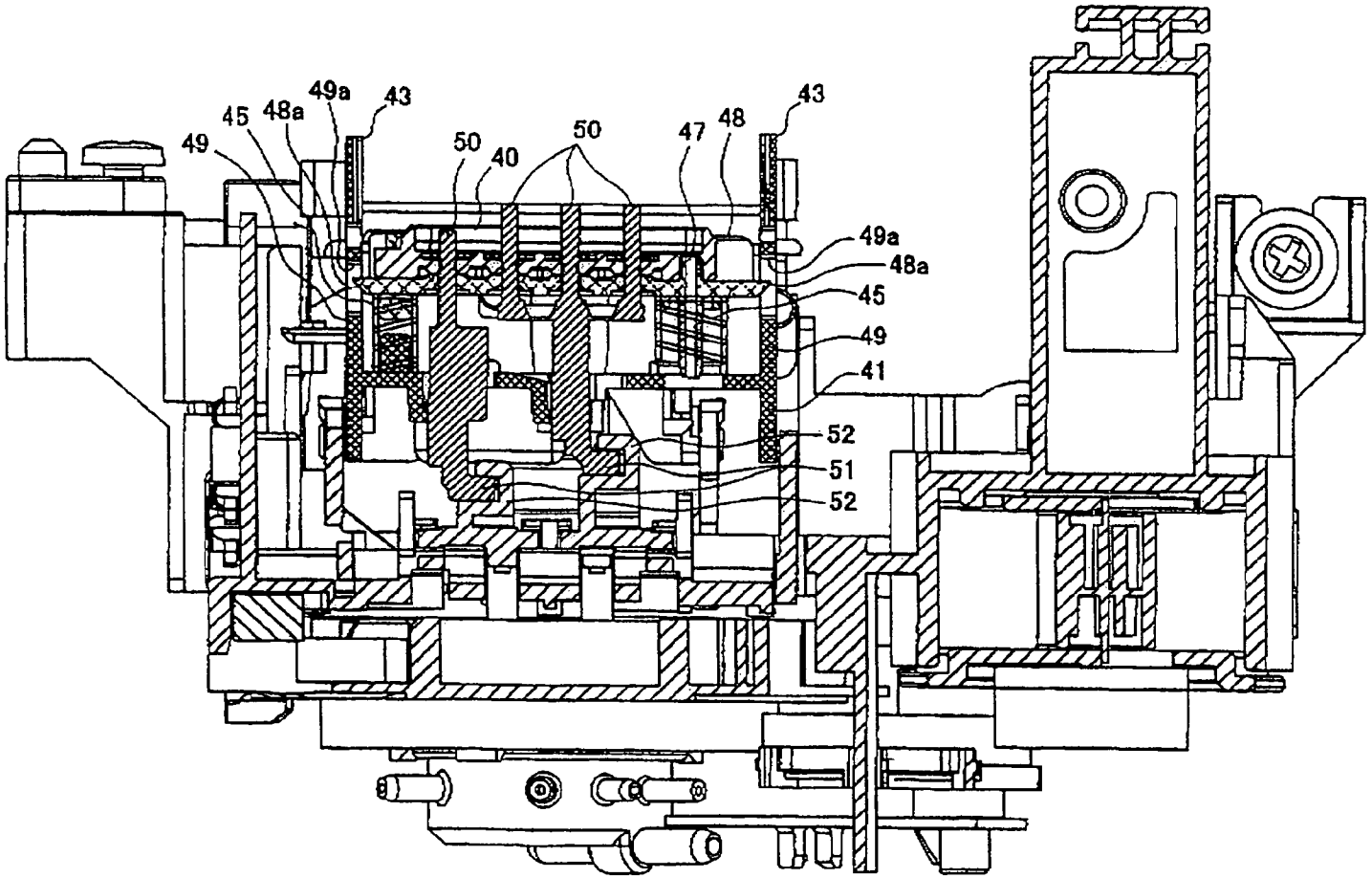
FIG. 11 is a cross-sectional view taken along A-A in FIG. 10.
Figure 12:
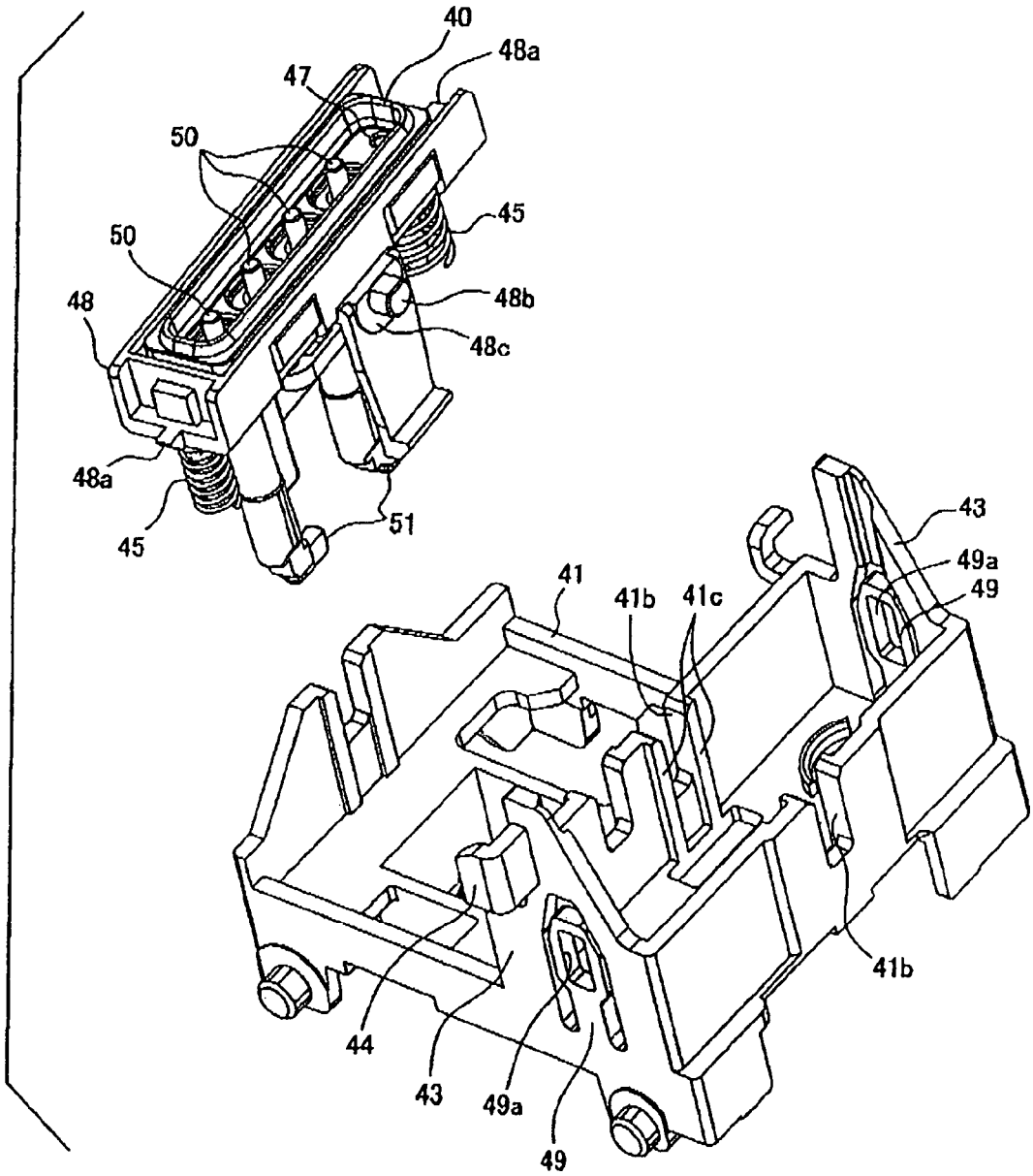
FIG. 12 is an exploded, perspective view of a supporting device that supports an air-discharge cap.

The lift member 41 supports, at the right-hand end portion thereof, an air-discharge cap 40 via two pushing-up springs 45 (FIG. 11) and an air-discharge-cap holder 48, such that the air-discharge cap 40, or an air-tight-space defining device including the air-discharge cap 40 and the air-discharge-cap holder 48 is movable relative to the lift member 41 in the vertical direction. As shown in FIGS. 10, 11, and 12, the air-discharge cap 40 that is formed of a silicone rubber has a generally rectangular shape elongate in the frontward and rearward directions, and includes a bottom wall and a side wall projecting upward from a periphery of the bottom wall to define an upward opening recess.

Figure 13:
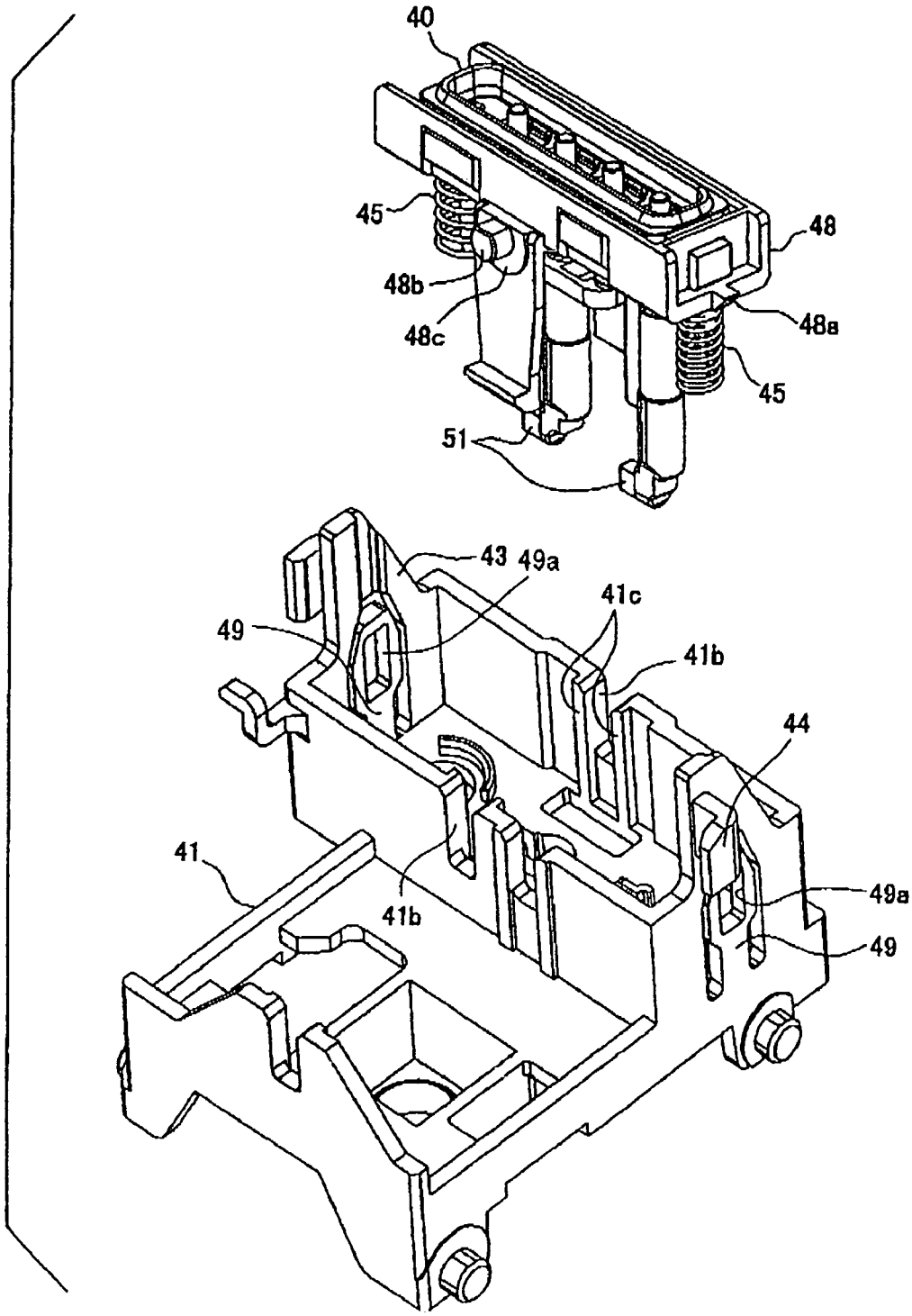
FIG. 13 is another exploded, perspective view of the supporting device.
Figure 14A:
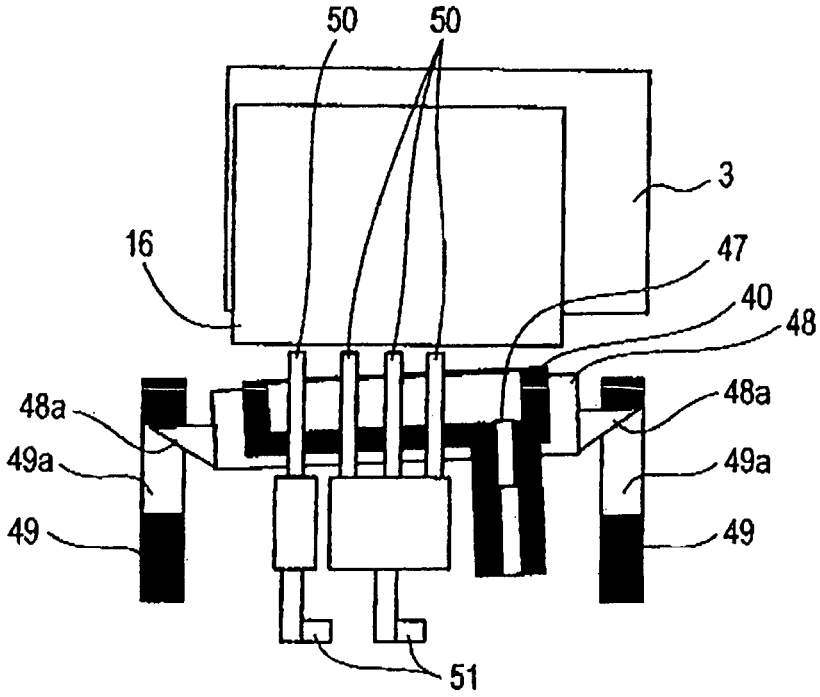
FIGS. 14A and 14B are illustrative views for explaining a manner in which the supporting device operates.
Figure 14B:
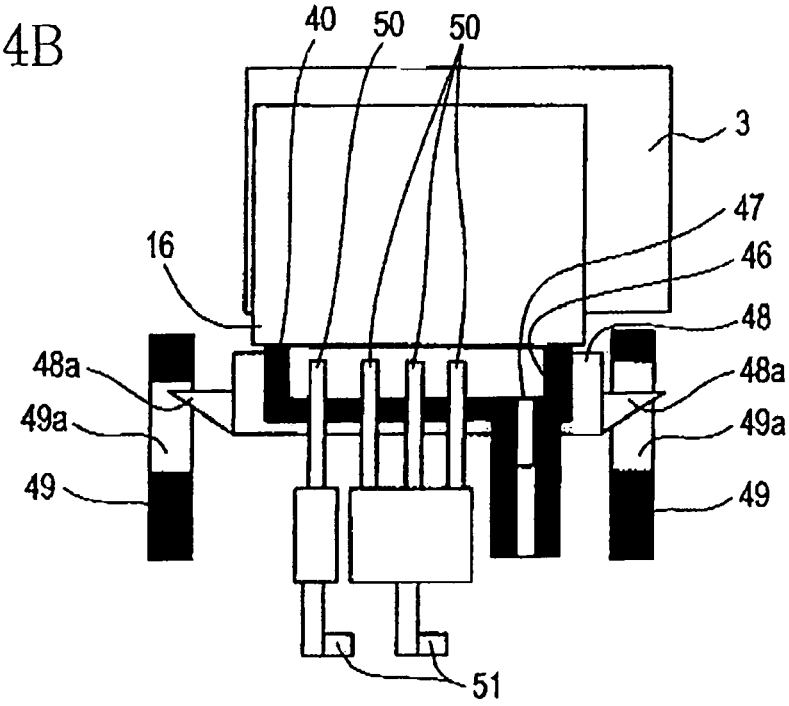

As shown in FIG. 12, the air-discharge cap 40 is supported or held by the air-discharge-cap holder 48. The air-discharge-cap holder 48 has, as integral portions thereof two projecting portions 48*a* as first engaging portions that project horizontally from front and rear side surfaces of the holder 48. Each of the two projecting portions 48*a* has a horizontal upper surface, and an inclined lower surface. Meanwhile, as shown in FIGS. 12 and 13, the lift member 41 has two elastic hook portions 49 as second engaging portions that are formed by mortising the two extending portions 48, respectively. The two elastic hook portions 49 have respective fitting holes 49*a* in which the two projecting portions 48*a* fit. As shown in FIGS. 14A and 14B, respective upper ends of the two fitting holes 49*a* (i.e., respective ends of the two fitting holes 49*a* that are located on the side of the carriage 3) have different height positions.

Back to FIGS. 12 and 13, the air-discharge-cap holder 48 has two axis portions 48*b* that project horizontally from left-hand and right-hand side surfaces of the holder 48, and the lift member 41 has two guide portions 41*b* that guide the two axis portions 48*b*, respectively. The air-discharge-cap holder 48 additionally has two base portions 48*c* each of which has a generally semicircular shape and surrounds, like a seat, a corresponding one of the two axis portions 48*b*. The lift member 41 additionally has two pairs of ribs 41*c* that are provided inside the two guide portions 41*b*, respectively, such that each pair of ribs 41*c* extend parallel to each other in the vertical direction. In a state in which the two guide portions 41*b* receive the two axis portions 48*b*, respectively, each pair of ribs 41*c* are opposed to each other via the corresponding axis portion 48*b* and are held in contact with the corresponding base portion 48*c*. The above-described two pushing-up springs 45 are provided, in a compressed state, between front and rear end portions of a lower surface of the air-discharge-cap holder 48 and an upper surface of the lift member 41. As shown in FIG. 14A, in the state in which the lift member 41 is positioned at the waiting position, the air-discharge cap 40 waits at a position lower than the bubble case 16 of the carriage 3. In this state, the two projecting portions 48*a* are engaged with the respective upper ends of the two fitting holes 49*a*, so that the air-discharge cap 40 extends in the frontward and rearward directions while being inclined relative to a horizontal plane, i.e., the lower surface of the bubble case 16.

As the lift member 41 is pushed by the carriage 3 and is displaced obliquely upward and rightward along the arcuate path toward the close-contact position, a lip portion as an upper end portion of the air-discharge cap 40 is brought into air-tight contact with the lower surface of the carriage 3 or the bubble case 16 while the degree of air-tightness of the contact is increased by the biasing force of the pushing-up springs 46. Because of this contact, the air-discharge cap 40 takes a horizontal posture, as shown in FIG. 14B. In this state, the upward opening recess of the air-discharge cap 40 and the lower surface of the bubble case 16 cooperate with each other to define an air-tight space 46 that communicates with each of the four discharge outlets 18 (FIG. 3). The air-discharge cap 40 has a suction hole 47 that is formed through a rear end portion of a bottom wall of the cap 40 so as to open in the upward opening recess of the same 40. The suction hole 47 communicates with an air-discharge port 78 of a switching device 70 (FIG. 6) via a tube member (not shown). The suction hole 47 may be formed through a thickness of the side wall of the air-discharge cap 40.

Operating Members 50 of Maintenance Unit 4>

Four bar-like operating members 50 (i.e., four opening and closing bars) that are arranged in an array in the frontward and rearward directions extend through the bottom wall of the air-discharge cap 40 and a bottom wall of the air-discharge-cap holder 48, such that each of the operating members 50 can air-tightly slide in the vertical direction relative to the respective bottom walls of the cap 40 and the holder 48. A front-side one of the four operating members 50 that corresponds to the black ink is solely movable in the vertical direction relative to the air-discharge cap 40 and of the air-discharge-cap holder 48, and a cam follower 51 projects rearward from a lower end of the front-side operating member 50. The other, three rear-side operating members 50 that correspond to the three color inks, respectively, are connected to each other at a position below the air-discharge cap 40, so that the three rear-side operating members 50 are movable as a unit in the vertical direction relative to the air-discharge cap 40 and of the air-discharge-cap holder 48. Another cam follower 51 projects rearward from a lower end of the connected rear-side operating members 50. As shown in FIG. 11, the two cam followers 51 are engaged with front and rear sliders 52, respectively, each of which is reciprocated in the leftward and rightward directions by a rotation of the cam 55. More specifically described, as shown in FIGS. 8 and 9, each of the two cam followers 51 is engaged with a free guide portion 54*a* or a cam guide portion 54*b* of a corresponding one of the two sliders 52. The sliders 52 will be described in detail, later.

Figure 15:
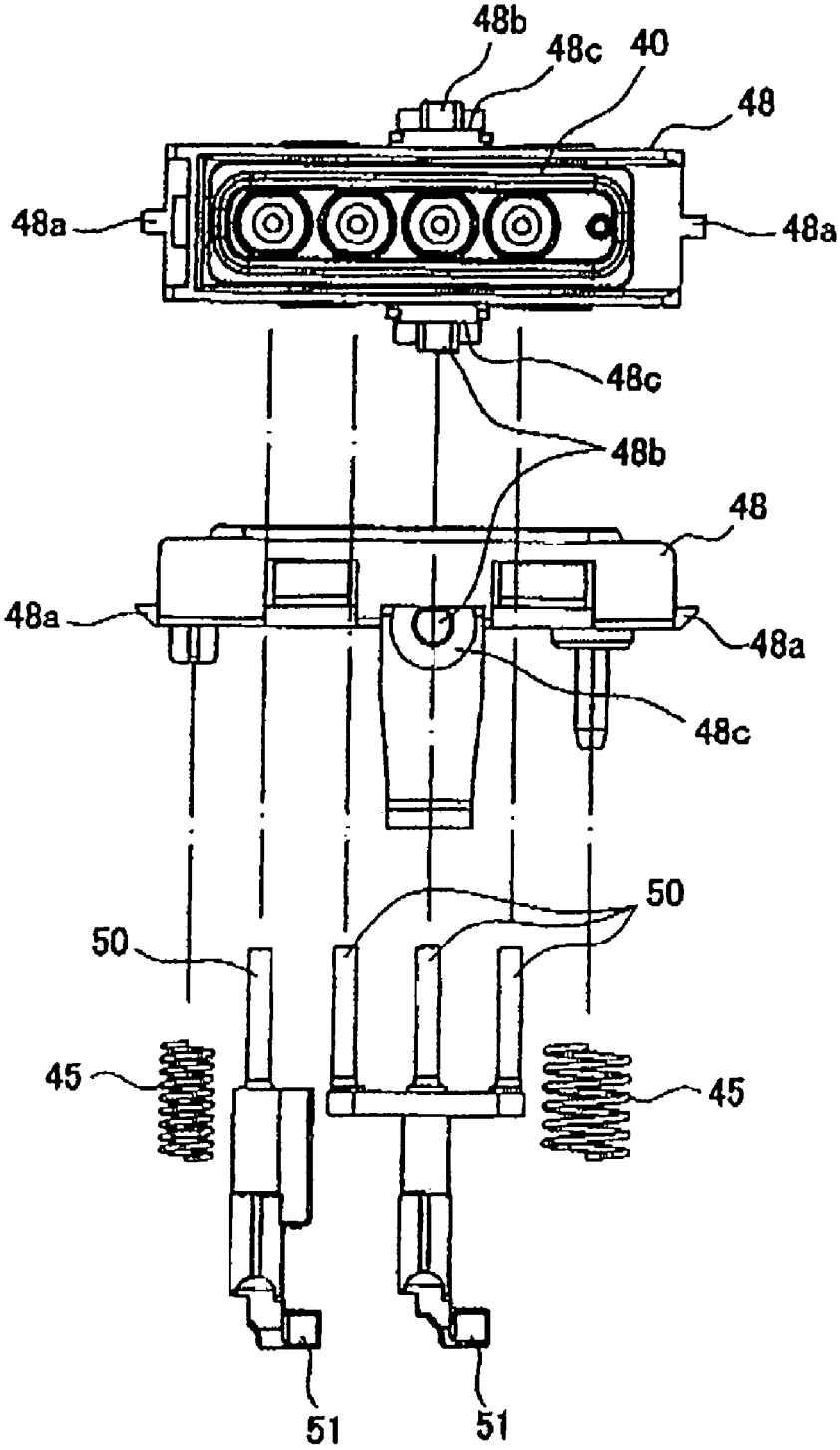
FIG. 15 is an exploded view showing respective constructions of the air-discharge cap, an air-discharge-cap holder, and the opening and closing members.

The air-discharge cap 40 and the air-discharge-cap holder 48 are displaced as a unit with the lift member 41. The operating members 50 are displaced as a unit with the air-discharge cap 40 and the air-discharge-cap holder 48 when those elements 50, 40, 48 are moved in the leftward and rightward directions, but the operating members 50 are movable relative to the air-discharge cap 40 and the air-discharge-cap holder 48 in the vertical direction. Since the operating members 50 are movable relative to the air-discharge cap 40 and the air-discharge-cap holder 48 in the vertical direction, the operating members 50 can be always held in engagement with the sliders 52, irrespective of which position may be taken by the lift member 41. FIG. 15 is an exploded view of the air-discharge cap 40, the air-discharge-cap holder 48, the pushing-up springs 45, and the operating members 50.

<Driving of Operating Members 50>

The cam 55 has, in an upper surface thereof, a cam groove 56. As shown in FIG. 16, the cam groove 56 includes a non-driving portion 56*a* having an arcuate shape concentric with the cam 55, and a driving portion 56*b* that is continuous with the non-driving portion 56*a* and is curved radially inward from the same 56*a*. The maintenance frame 111 supports the front and rear sliders 52 such that each one of the two sliders 52 can translate, above the cam 55, independent of the other slider 52 in the leftward and rightward directions, i.e., the opposite directions parallel to the opposite directions in which the carriage 3 is reciprocated. Each of the two sliders 52 has a cam follower (not shown) that projects downward to engage the cam groove 56 at a position on a right-hand side of the center of the cam 55. In a state in which the cam follower of each slider 52 is engaged with the non-driving portion 56*a* of the cam groove 56, the each slider 52 waits at a right-hand position shown in FIG. 8 or FIG. 9; and in a state in which the cam follower is engaged with the driving portion 56*b* of the cam groove 56, the each slider 52 is moved and positioned at a left-hand position shown in FIG. 17. The rear slider 52 is for driving the three operating members 50 corresponding to the three color inks, and the front slider 52 is for driving the single operating member 50 corresponding to the black ink.

Figure 17:
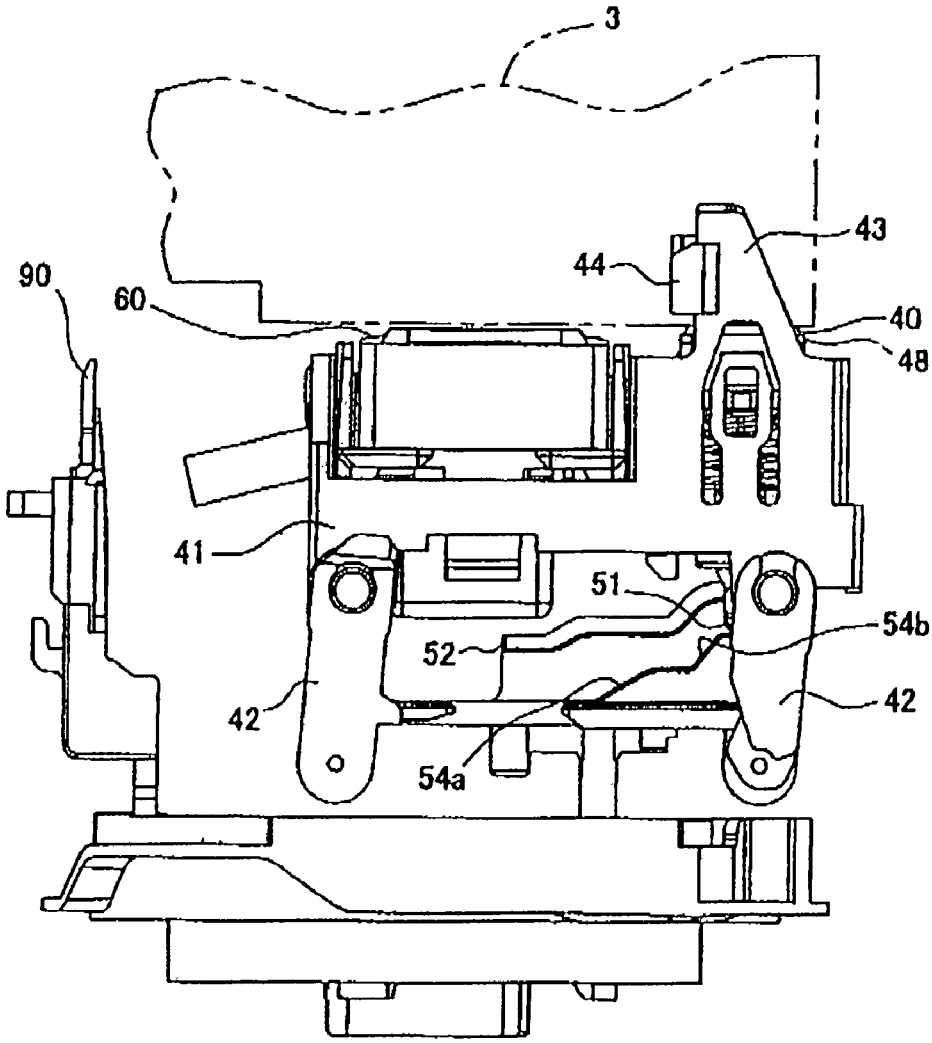
FIG. 17 is an illustrative front view showing a state in which the carriage is positioned at the origin position and the opening and closing members are positioned at respective valve opening positions.

As described above, each of the two sliders 52 has the free guide portion 54*a* and the cam guide portion 54*b* each of which can engage a corresponding one of the two cam followers 51 of the four operating members 50. As shown in FIG. 17, the free guide portion 54*a* extends straight in the leftward and rightward directions, i.e., the opposite directions parallel to the opposite directions in which the each slider 52 is reciprocated, and includes an inclined right-hand end portion that is inclined obliquely upward and rightward. The cam guide portion 54*b* is continuous with the right-hand end of the free guide portion 54*a*, and includes an inclined right-hand end portion that is inclined obliquely upward and rightward.

In the state, shown in FIG. 8, in which the lift member 41 is positioned at the waiting position, each of the two cam followers 51 is engaged with the free portion guide 54*a* of a corresponding one of the two sliders 52, and is not engaged with the cam guide portion 54*b* thereof, irrespective of which one of the non-driving portion 56*a* and the driving portion 56*b* the one slider 52 may be engaged with. When the lift member 41 is moved to the close-contact position by the carriage 3, the each cam follower 51 is moved as a unit with the lift member 41 in the rightward direction, so as to engage the cam guide portion 54*b* of the one slider 52, as shown in FIG. 9. If then, the cam follower (not shown) of the one slider 52 is engaged with the non-driving portion 56*a*, the each cam follower 51 is engaged with the lowest, left-hand end portion of the cam guide portion 54*b* that is level with the right-hand end portion of the free guide portion 54*a*, so that the corresponding operating member or members 50 waits or wait at the lowest, valve-closing position or positions thereof where an upper end or ends of the operating member or members 50 is or are positioned at a height position or positions lower than a lower end or ends of the valve member or members 20 of the corresponding opening and closing valve or valves 19 (FIGS. 3 and 4). In this state, the corresponding opening and closing valve or valves 19 is or are maintained at the closed state or states thereof.

If, from the above-described state, the cam follower of the one slider 52 is changed to be engaged with the driving portion 56*b* and accordingly is moved in the leftward direction, the each cam follower 51 is moved relative to the cam guide portion 54*b* in the rightward direction so as to climb the inclined portion of the cam guide portion 54*b*, as shown in FIG. 17, so that the corresponding operating member or members 50 is or are moved upward from the valve-closing position or positions thereof to a valve-opening position or positions thereof where the upper end or ends of the operating member or members 50 engages or engage, and push upward, the lower end or ends of the valve member or members 20 of the corresponding opening and closing valve or valves 19. Thus, the corresponding opening and closing valve or valves 19 is or are placed in the open state or states thereof. The cam 55 additionally has, in the upper surface thereof a cam groove 57 that is for moving the wiper 90 upward and downward.

Nozzle Cap 60 of Maintenance Unit 4>

On a left-hand side of the air-discharge cap 40, the lift member 41 supports a nozzle cap 60 via pushing-up springs (not shown), such that the nozzle cap 60 is movable in the upward and downward directions relative to the lift member 41. The nozzle cap 60 is formed of a silicone rubber, has a generally rectangular shape elongate in the frontward and rearward directions, and has left-hand and right-hand recesses each of which opens upward and accommodates a spacer member 62 (FIG. 3) therein. The spacer member 62 has a transverse cross section that is upwardly convex. In the state in which the lift member 41 is positioned at the waiting position, the nozzle cap 60 waits at a height position lower than the lower surface of the carriage 3. As the lift member 41 is pushed by the carriage 3 and is moved obliquely upward and rightward along the arcuate path toward the close-contact position, a lip portion as an upper end portion of the nozzle cap 60 is brought into liquid-tight contact with the lower surface of the carriage 3 while the degree of liquid-tightness of the contact is increased by the biasing force of the pushing-up springs. In this state, respective upper surfaces of the two spacer members 62 and the lower surface of the carriage 3 cooperate with each other to define left-hand and right-hand liquid-tight spares that are independent of each other and that communicate with the nozzles of the recording heads 10. One of the left-hand and right-hand liquid-tight spaces corresponds to the nozzles for the black ink, and the other liquid-tight space corresponds to the nozzles for the three color inks.

Like the recess of the air-discharge cap 40, each of the two recesses of the nozzle cap 60 has a suction hole 64 (FIG. 3) that is formed through a rear end portion (i.e., one of lengthwise opposite end portions) of a bottom wall of the each recess so as to open in the each recess. The suction hole 64 corresponding to the black ink communicates with a black-ink port 79 (hereinafter, referred to as the Bk port 79) of the switching device 70 (FIG. 6) via a tube member (not shown), and the suction hole 64 corresponding to the three color inks communicates with a color-ink port 80 (hereinafter, referred to as the Co port 80) of the switching device 70 via another tube member (not shown).

<Switching Device 70 of Maintenance Unit 4>

As shown in FIGS. 5 and 6, the switching device 70 has not only the function of switching the air-tight space 46 defined by the air-discharge cap 40, between its communication state in which the space 46 communicates with the pump 38 and its shut-off state in which the space 46 is shut off from the pump 38, but also the function of switching each of the two liquid-tight spaces defined by the nozzle cap 60, between its communication state in which the each liquid-tight space communicates with the pump 38 and its shut-off state in which the each liquid-tight space is shut off from the pump 38. The switching device 70 includes an attachment portion 71 provided on a lower surface of the cam 55, a switching member 73, and a cover member 76.

As shown in FIG. 5, the attachment portion 71 has an annular shape that is concentric with each of the cam 55 and the follower gear 36, and includes a plurality of positioning projections 72 formed on an outer circumferential surface of the annular wall thereof. The switching member 73 is formed of a rubber, has a disc-like shape, and has four switching flow passages 74 formed on outer surfaces thereof. The four switching flow passages 74 include four branch grooves 74*a* that radially extend from a center of a lower surface of the switching member 73, and four communication grooves 74*b* that are formed in an outer circumferential surface of the switching member 73 such that the four communication grooves 74*b* communicate with the four branch grooves 74*a*, respectively. The switching member 73 fits on the attachment portion 71, such that the positioning projections 72 of the attachment portion 71 fit in respective positioning grooves (not shown) formed in an upper surface of the switching member 73. Thus, the switching member 73 is attached to the cam 55 via the attachment portion 71 such that the switching member 73 is concentric with the cam 55 and the follower gear 36 and is rotatable as a unit with those elements 55, 36.

The cover member 76 is formed of a synthetic resin, and has a cylindrical shape with a bottom wall. The bottom wall of the cover member 76 has, at a center thereof an air-suction port 77 that is connected to the pump 38 via a tube member (not shown). A cylindrical side wall of the cover member 76 has five ports 78, 79, 80, 81, 82 that are angularly spaced from each other in a circumferential direction of the side wall. The five ports 78 through 82 includes the air-discharge port 78 that communicates with the air-tight space 46 defined by the air-discharge cap 40, the Bk port 79 that communicates with the black-ink-related liquid-tight space defined by the nozzle cap 60, the Co port 80 that communicates with the color-ink-related liquid-tight space defined by the nozzle cap 60, and two atmosphere ports 81, 82 each of which communicates with the atmosphere.

The cover member 76 is attached to the cam 55 owing to three engaging projections 83 formed on the lower surface of the cam 55. More specifically described, the cover member 76 has an outer flange 84 that continuously extends over an entire circumference thereof, and the three engaging projections 83 are angularly spaced from each other on a circle concentric with the cam 55. Each of the engaging projections 83 is elastically deformable in a radial direction of the cam 55. When the cover member 76 is pressed against the lower surface of the cam 55, the three engaging projections 83 are first elastically deformed radially outward and then are elastically restored radially inward so as to engage a lower surface of the outer flange 84 of the cover member 76. Thus, the cover member 76 is supported by the cam 55 such that the cover member 76 is rotatable relative to the cam 55 and the switch member 73 but a displacement of the cover member 76 relative to those members 55, 73 in the upward and downward directions (i.e., directions parallel to an axis of rotation of the cam 55) is restricted. In the state in which the cover member 76 is attached to the cam 55, the switching member 73 is accommodated by an inner space of the cover member 76, and a lip portion as an outer circumferential portion of the switching member 73 is held in close contact with an inner circumferential surface of the cover member 76. Therefore, when the cover member 76 and the switching member 73 are rotated relative to each other, a sliding resistance (i.e., a frictional resistance) is produced between the lip portion of the switching member 73 and the inner circumferential surface of the cover member 76.

The cover member 76 includes, as an integral portion thereof an arm portion 85 extending radially outward from the outer circumference thereof. A free end portion of the arm portion 85 fits on the axis portion 33 of the sun gear 32, such that the arm portion 85 is rotatable relative to the axis portion 33. Since the arm portion 85 fits on the axis portion 33, the cover member 76 is maintained at a state in which a rotation of the cover member 76 relative to the maintenance frame 111 is restricted, and accordingly respective positions of the ports 78 through 82 of the cover member 76 are fixed. The axis portion 33 has an engaging projection 33*a* that engages the arm portion 85 so as to prevent the arm portion 85 from falling off the axis portion 33. Between the arm portion 85 and the sun gear 32 provided above the arm portion 85, the above-described revolving arm 34 is provided such that the revolving arm 34 is permitted to rotate relative to the axis portion 33.

As the cover member 76 is rotated relative to the switching member 73, the switching device 70 is selectively switched to a first state in which none of the four communication grooves 74*b* of the switching member 73 communicate with any of the ports 78 through 82 of the cover member 76, and a second state in which one, two, or three grooves of the four communication grooves 74*b* communicates or communicate with one, two, or three ports of the ports 78 through 82. In the first state, all the ports 78 through 82 are shut off from the pump 38. In the second state, one port 78 through 82 that communicates with one communication groove 74*b* communicates with the pump 38 via one communication passage 74, or two or more ports 78 through 82 that communicate with two or more communication grooves 74 not only communicate with each other, but also communicate with the pump 38, via two or more communication passages 74. Specific switching modes of the switching device 70 will be described in detail, later.

<Carriage Lock 100 of Maintenance Unit 4>

The cam 55 includes an outer flange 101 that has an annular shape and has, as a lower surface thereof, a cam surface 102. The cam surface 102 includes a locking area in the form of a recess formed therein, and an unlocking area as the remaining portion thereof. Thus, the locking area has a height position higher than that of the unlocking area. As shown in FIG. 7, a carriage lock 100 is supported by the maintenance frame 111 such that the carriage lock 100 is movable in the upward and downward directions and is biased in the upward direction by a spring (not shown). Thus, a cam follower 103 formed in a lower end portion of the carriage lock 100 is held in pressed contact with the cam surface 102. Thus, a major portion of the carriage lock 100 is located above the cam 55. In a state in which the cam follower 103 is held in contact with the unlocking area of the cam surface 102, the carriage lock 100 is positioned at a lower position, i.e., an unlocking position; and in a state in which the cam follower 103 is held in contact with the locking area of the cam surface 102, the carriage lock 100 is permitted to move upward and advance into the path of movement of the carriage 3. If, then, the carriage 3 is positioned at the origin position (i.e., the maintenance position), an upper end portion of the carriage lock 100 engages a front end portion of a left-hand side surface of the carriage 3, so as to restrict the movement of the carriage 3 in the leftward direction toward the recording area 8.

<Control of Rotation Position of Cam 55>

The outer flange 101 of the cam 55 is provided with detection portions 105, such that the detection portions 105 are rotatable as a unit with the cam 55. In addition, the maintenance frame 111 supports a leaf switch 106 that is turned ON or OFF by each of the detection portions 105 as the cam 55 is rotated. When the leaf switch 106 is turned ON or OFF (i.e., each of positions "A(M)", "N", "O", "P", "Q", "R", "S", and "K" shown in FIG. 18), a controller 24 (FIG. 3) starts counting a rotation amount of the electric motor 23 that drives the cam 55, so as to control accurately a position where the cam 55 is to be stopped. However, in the following description of various steps such as a maintenance step, the operation of the leaf switch 106 and the control of rotation position of the cam 55 based thereon are not described. The controller 24 is constituted by a microcomputer including a central processing unit (CPU), a read only memory (ROM), and a random access memory (RAM).

<Movement of Carriage 8 and Operation of Lift Member 41>

In the state in which the lift member 41 is positioned at the waiting position by the biasing force of the above-described returning spring (not shown), if the carriage 3 is moved from the recording area 8 to the origin position, the carriage 3 engages the engaging plates 44 of the lift member 41. At this point of time, both the air-discharge cap 40 and the nozzle cap 60 are positioned below the lower surface of the carriage 3. That is, the two caps 40, 60 are not in contact with the lower surface of the carriage 3, i.e., are separate from the lower surface.

If the carriage 3 is additionally moved toward the origin position, the lift member 41 is moved obliquely upward and rightward along the arcuate path, so that the nozzle cap 60 starts contacting respective lower surfaces (i.e., respective nozzle-opening surfaces) of the recording heads 10. If the carriage 3 is further moved in the rightward direction, the pushing-up springs provided between the lift member 41 and the nozzle cap 60 held in contact with the lower surface of the carriage 3 are elastically compressed and, owing to respective elastic restoring forces of the springs being compressed, the nozzle cap 60 is strongly pressed against the lower surfaces of the recording heads 10, so that the two liquid-tight spaces being liquid-tightly sealed with reliability are defined between the lower surfaces and the nozzle cap 60.

If the carriage 3 is further moved in the rightward direction and eventually reaches the origin position, as shown in FIG. 9, the air-discharge cap 40 is brought into close contact with the lower surface of the carriage 3 or the bubble case 16 and, owing to respective elastic forces of the pushing-up springs 45 provided between the lift member 41 and the air-discharge cap 40, the air-discharge cap 40 is strongly pressed against the lower surface of the carriage 3, so that the air-tight space 46 being air-tightly sealed with reliability is defined between the lower surface of the carriage 3 and the air-discharge cap 40.

<Air Discharging Step and Discharged-Ink Sucking Step for Maintenance>

During an initial period of an air discharging step to discharge the air bubbles collected by the air-bubble collecting chambers 12, the carriage 3 is positioned at the origin position and is locked thereat by the engagement thereof with the carriage lock 100. In the state in which the carriage 3 is locked at the origin position, the air-discharge cap 40 is held in close contact with the lower surface of the carriage 40 so as to define the air-tight space 46, as shown in FIG. 14B. In this state, the cam 55 and the switching member 73 are positioned at Position A (M) shown in FIG. 18 where the air-tight space 46 is not communicated with, i.e., is shut off from, the atmosphere and the pump 38. In addition, the black-ink-related liquid-tight space and the color-ink-related liquid-tight space, each defined by the nozzle cap 60, are communicated with the atmosphere and the pump 38 via the switching flow passages 74 of the switching member 73.

Figure 18:
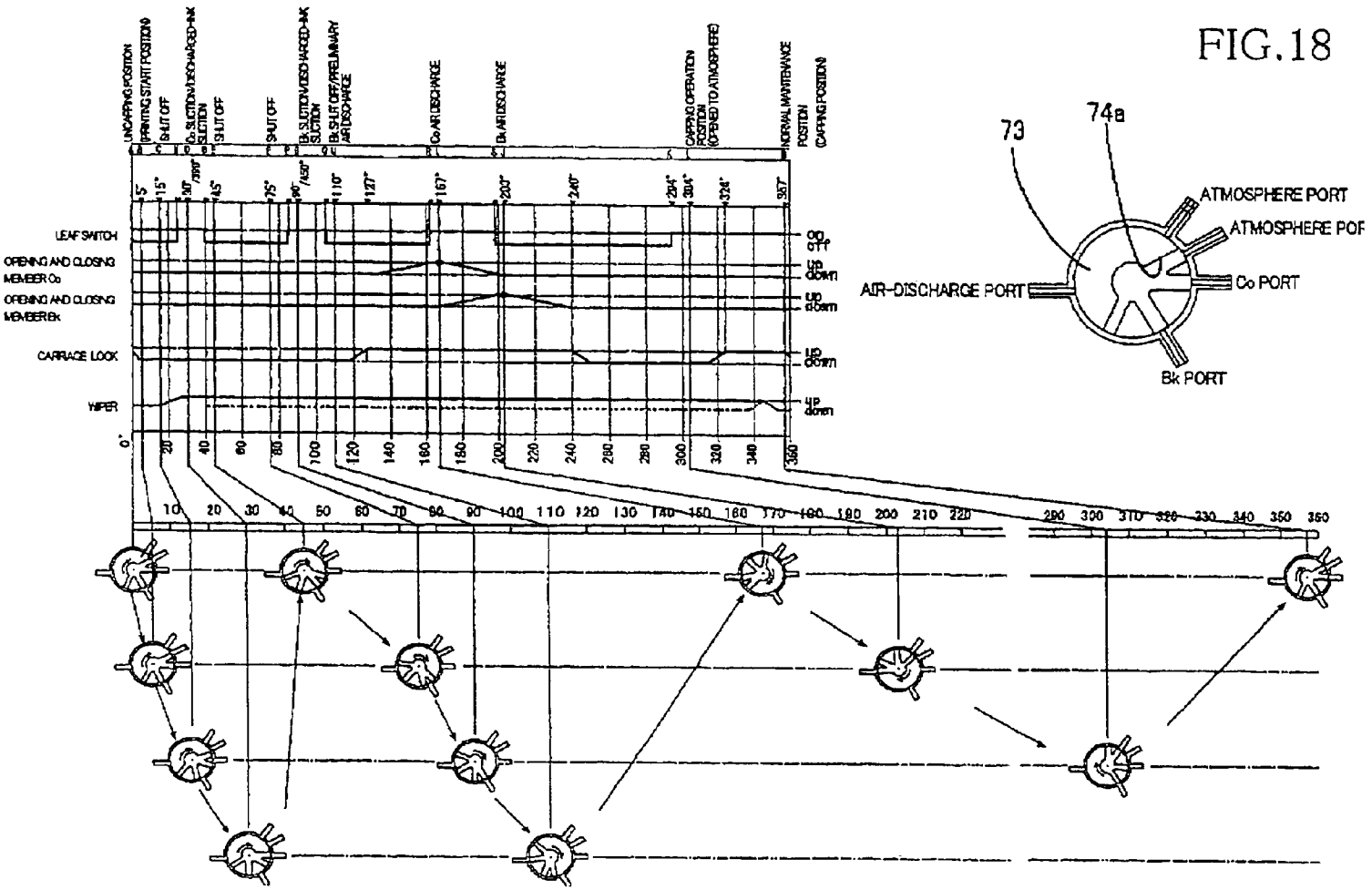
FIG. 18 is a timing chart showing a relationship between rotation (i.e., angular) positions of the cam (and a switching member), the valve opening and closing positions of the opening and closing members, and locking and unlocking positions of a carriage lock.

If, from the above-indicated state, the cam 55 and the switching member 73 are rotated to, and stopped at, Position H shown in FIG. 18, the air-tight space 46 is communicated with the pump 38 only, via the switching member 73. In this state, the two liquid-tight spaces defined by the nozzle cap 60 are shut off from the atmosphere and the pump 38. When the planetary gear 35 is revolved and is rotated to drive the pump 38, by the electric motor 23 under control of the controller 24, the air present in the air-tight space 46 is discharged and an air pressure in the space 46 becomes negative. This is a preliminary air discharging action.

After the preliminary air discharging action, the cam 55 and the switching member 73 are moved or rotated to Position I. During this rotation, the color-ink-related slider 52 is moved in the leftward direction by the engagement of the cam follower thereof with the driving area 56*b* of the cam groove 56 of the cam 55, so that the color-ink-related operating members 50 are pushed upward from their valve closing positions to their valve opening positions and accordingly the three opening and closing valves 19 provided in the three discharging passages 17 corresponding to the three color inks are placed in their open states. In this state, the air-tight space 46 is communicated with the pump 38 only, and the two liquid-tight spaces defined by the nozzle cap 60 are shut off from the atmosphere and the pump 38. When the pump 38 is driven at Position I, the air bubbles collected by the three air-bubble collecting chambers 12 corresponding to the three color inks are discharged into the atmosphere via the discharging passages 17, the air-tight space 46, the switching flow passages 74, and the pump 38. Thus, during the air discharging step, the two liquid-tight spaces defined by the nozzle cap 60 remain shut off from the atmosphere and the pump 38.

Figure 19A:
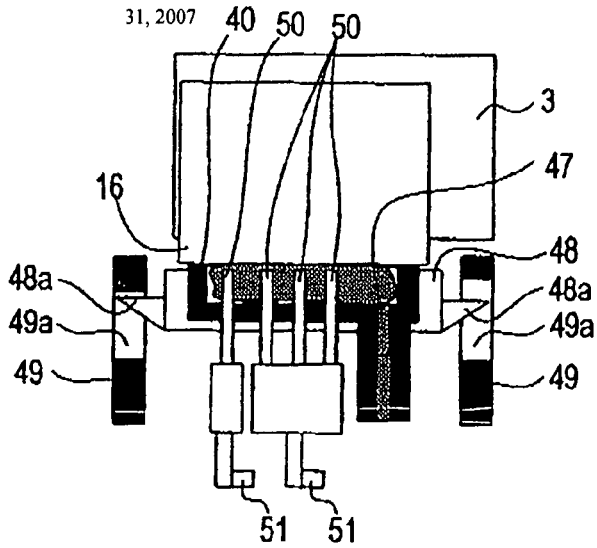
FIGS. 19A, 19B, and 19C are other illustrative views for explaining the manner in which the supporting device operates.

After the air bubbles have been discharged from the air-bubble collecting chambers 12 corresponding to the color inks into the atmosphere by the pump 38, the cam 55 and the switching member 73 are moved to Position J. During this movement, the color-ink-related slider 52 is moved in the rightward direction so that the color-ink-related operating members 50 are moved down to their valve closing positions and accordingly the three opening and closing valves 19 corresponding to the three color inks are returned to their closed states. Simultaneously, the black-ink-related slider 52 is moved in the leftward direction by the engagement of the cam follower thereof with the driving area 56*b* of the cam groove 56 of the cam 55, so that the black-ink-related operating member 50 is pushed up from its valve closing position to its valve opening position and accordingly the opening and closing valve 19 provided in the discharging passage 17 corresponding to the black ink is placed in its open state. Like Position I, Position J establishes the state in which the air-tight space 46 is communicated with the pump 38 only, and the two liquid-tight spaces defined by the nozzle cap 60 are shut off from the atmosphere and the pump 38. When the pump 38 is driven at Position J, the air bubbles collected by the air-bubble collecting chamber 12 corresponding to the black ink is discharged into the atmosphere via the discharging passage 17, the air-tight space 46, the switching flow passage 74, and the pump 38. During this air discharging step, too, the two liquid-tight spaces defined by the nozzle cap 60 remain shut off from the atmosphere and the pump 38. Subsequently, the cam 55 and the switching member 73 are moved to Position A. During this movement, the black-ink-related slider 52 is moved in the rightward direction so that the black-ink-related operating member 50 is moved down to its valve closing position, as shown in FIG. 19A, and accordingly the opening and closing valve 19 corresponding to the black ink is returned to its closed state. In this way, the two air discharging steps to discharge the air bubbles from the four air-bubble collecting chambers 12 are completed. During the air discharging steps, the carriage 3 remains positioned at the origin position.

Figure 19B:
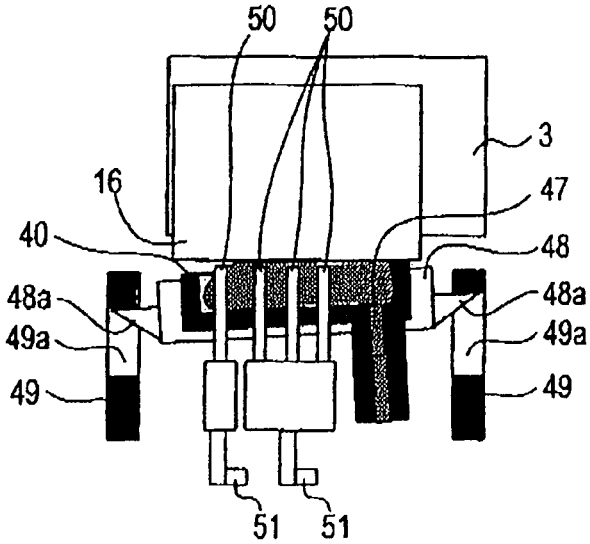
Figure 20:
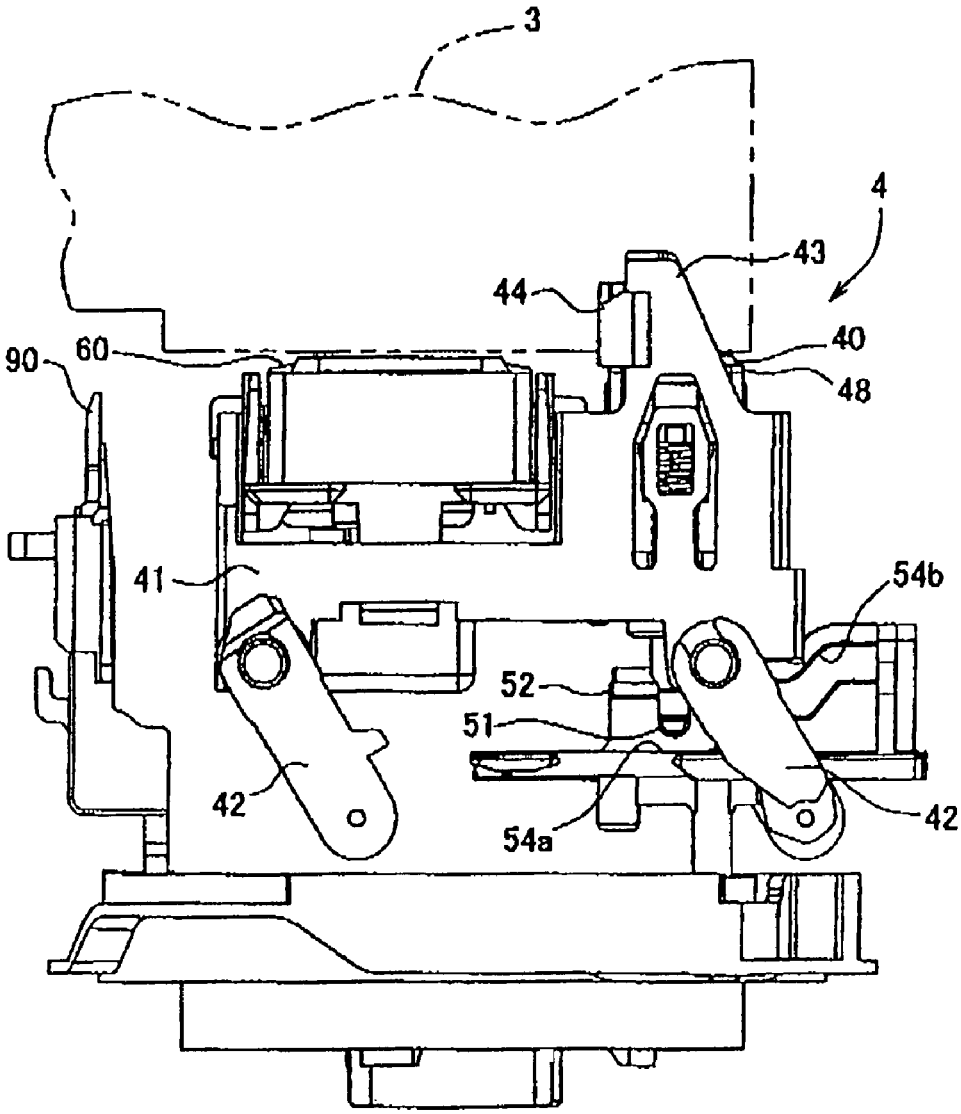
FIG. 20 is an illustrative front view showing a state in which the carriage is positioned at a discharged-ink suction position.

Then, the cam 55 and the switching member 73 are moved to Position B, and the carriage lock 100 is moved down so that the carriage 3 is released from the engaged state, i.e., the locked state. Like Position A, Position B establishes the state in which the air-tight space 46 is shut off from the atmosphere and the pump 38 and the two liquid-tight spaces defined by the nozzle cap 60 are communicated with the atmosphere and the pump 38. After the carriage 3 has been released from the locked state, the carriage 3 is moved from the origin position to the discharged-ink suction position shown in FIG. 20, and accordingly the lift member 41 is moved obliquely leftward and downward. During this movement, the front projecting portion 48*a* of the air-discharge-cap holder 48 engages the upper end of the corresponding fitting hole 49*a* of the lift member 41 at an earlier time than a time when the rear projecting portion 48*a* engages the upper end of the corresponding fitting hole 49*a*. Therefore, as shown in FIG. 19B, the air-discharge cap 40 is inclined such that the front end portion thereof is lower than the rear end portion thereof, and accordingly a gap as an air flow inlet is formed between the air-discharge cap 40 and the lower surface of the carriage 3 or the bubble case 16. Subsequently, the cam 55 and the switching member 73 are moved to Position H wherein the upward opening recess of the air-discharge cap 40 is communicated with the pump 38. When the pump 38 is driven, the inks that have been discharged together with the air bubbles (i.e., the air) from the air-bubble collecting chambers 12 into the cap 40 (i.e., the recess thereof during the two air discharging steps are sucked and discharged by the pump 38.

Figure 19C:
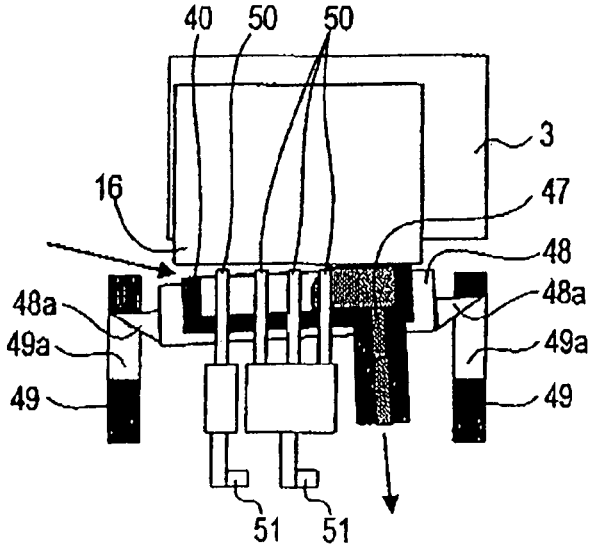

During the discharged-ink sucking step, the gap is formed or produced between the carriage 3 and the front end portion of the air-discharge cap 40 that is opposite to the suction hole 47 in the lengthwise direction of the cap 40. When, in this state, the discharged inks are sucked through the suction hole 47, air flows are generated in a direction from the gap toward the suction hole 47, as indicated by an arrow in FIG. 19C. Thus, the discharged inks are effectively prevented from remaining in the air-discharge cap 40.

Subsequently, the cam 55 and the switching member 73 are moved to Position L where the air-tight space 46 is shut off from the atmosphere and the pump 38 and the two liquid-tight spaces defined by the nozzle cap 60 are communicated with the atmosphere and the pump 38. If, from this state, the carriage 3 is returned from the discharged-ink suction position to the origin position, the air-discharge cap 40 is closely contacted with the carriage 3 to establish the air-tight space 46 shut off from the atmosphere, and the nozzle cap 60 is closely contacted with the carriage 3 to establish the two liquid-tight spaces. Subsequently, the cam 55 and the switching member 73 are moved to Position A (M). Thus, the air discharging steps and the discharged-ink sucking step are completed.

<Ink Purging Step for Maintenance>

During an initial period of an ink purging step to suck and discharge the inks clogging the nozzles of the recording heads 10 and the air bubbles contained in those inks, the carriage 3 is locked at the origin position, and the air-tight space 46 is established by the air-discharge cap 40 and the two liquid-tight spaces are established by the nozzle cap 60. In this state, the cam 55 and the switching member 73 are positioned at Position A shown in FIG. 18 where the black-ink-related liquid-tight space and the color-ink-related liquid-tight space, each defined by the nozzle cap 60, are communicated with the atmosphere and the pump 38 via the switching member 73, and the air-tight space 46 is shut off from the atmosphere and the pump 38.

If, from the above-indicated state, the cam 55 and the switching member 73 are rotated to Position F, the two liquid-tight spaces defined by the nozzle cap 60 are shut off from the atmosphere and the pump 38, and the air-tight space 46 remains shut off from the pump 38 and the atmosphere. In this state, the pump 38 is driven so that an air pressure in the pump 38 and the switching flow passages 74 is decreased to be negative, i.e., lower than an atmospheric pressure.

Subsequently, if the cam 55 and the switching member 73 are rotated to Position G, then the black-ink-related liquid-tight space defined by the nozzle cap 60 is communicated with the pump 38 via the switching member 73, so that the black ink clogging the nozzles of the corresponding recording head 10 is quickly sucked toward the pump 38. In this state, the color-ink-related liquid-tight space defined by the nozzle cap 60 and the air-tight space 46 are shut off from the atmosphere and the pump 38. This is a black-ink purging step.

After the black-ink purging step, the cam 55 and the switching member 73 are rotated to Position H where only the air-tight space 46 is communicated with the pump 38, and the two liquid-tight spaces defined by the nozzle cap 60 are shut off from the atmosphere and the pump 38.

Subsequently, the carriage 3 is moved from the origin position to the discharged-ink suction position and further moved to the recording area 8, and then is returned to the discharged-ink suction position. Thereafter, the cam 55 and the switching member 73 are rotated from Position H to Position G where only the black-ink-related recess of the nozzle cap 60 is communicated with the pump 38. When the pump 38 is driven, the black ink remaining in the black-ink-related recess of the nozzle cap 60 is sucked and removed by the pump 38.

Thereafter, the cam 55 and the switching member 73 are rotated to Position L where the black-ink-related recess and the color-ink-related recess of the nozzle cap 60 are communicated with the atmosphere and the pump 38. In this state, the recess of the air-discharge cap 40 is shut off from the pump 88. When the pump 38 is driven to perform another discharged-ink sucking action, the black ink remaining in the switching flow passage 74 communicating with the atmosphere port 82 is sucked and removed by the pump 38.

Subsequently, the carriage 3 is returned from the discharged-ink suction position to the origin position, so as to form the air-tight space 46 and the black-ink-related and color-ink-related liquid-tight spaces. Then, the cam 55 and the switching member 73 are rotated to Position A (M). Thus, the black-ink purging step is completed.

A color-ink purging step is carried out like the above-described black-ink purging step. However, Positions F, G, and H for the production of negative pressure and the suction of black ink in the black-ink purging step are changed to Positions C, D, and E, respectively, and Position G for the suction of discharged black ink is changed to Position D.

In the present embodiment, the negative pressure is produced before each ink purging step is carried out, so that with the negative pressure, the ink(s) can be sucked up all at once. However, it is possible to carry out each ink purging step without producing the negative pressure in advance. In the latter case, it is possible to omit stopping the cam 55 and the switching member 73 at Position F corresponding to the black ink, or Position C corresponding to the color inks, where the air is sucked by the pump 38.

In the present embodiment, the two projecting portions 48*a* of the air-discharge-cap holder 48, the respective fitting holes 49*a* of the two hook portions 49 of the lift member 41, the two pushing-up springs 45, the four links 42, the returning spring (not shown), and the carriage 3 cooperate with each other to constitute an air-flow generating device, a separating device, or an inclining device.

<Advantages>

(1) When the air bubbles (i.e., the air) accumulated in the air-bubble collecting chambers 12 are discharged, first, the air-discharge cap 40 is brought into close contact with the carriage 3 so as to define the air-tight space 46, and the valve opening and closing members 50 are operated to open the opening and closing valves 19 so that the air-bubble collecting chambers 12 communicate with the air-tight space 46, and then the pump 38 is operated to suck the air from the air-tight space 46 and discharge the sucked air into the atmosphere. Thus, when the air bubbles are discharged, the air flows in one way from the air-bubble collecting chambers 12 to the atmosphere via the air-tight space 46 and the pump 38. Therefore, ambient air is effectively prevented from entering the air-bubble collecting chambers 12 or the ink flow passages (i.e., the tubes 14, the ink-flow chambers 13, and the bubble case 16), i.e., from being mixed with the inks.

In addition, as compared with a method in which a negative pressure is applied to the nozzles of the recording heads 10 so as to suck inks from the nozzles and thereby remove air bubbles mixed with the inks, amounts of inks that are uselessly consumed can be reduced and accordingly a running cost of the ink-jet printer can be decreased. Moreover, in the present embodiment, the air bubbles can be discharged in a shorter time.

(2) The opening and closing valves 19 are opened by the valve opening and closing members 50, in the state in which the air-discharge cap 40 is held in contact with the carriage 3 and the air-tight space 46 is defined. In this state, the discharging passages 17 that are used to discharge the air bubbles is shut off from the atmosphere. Therefore, ambient air is prevented from entering the air-bubble collecting chambers 12. Thus, the air pressure in the air-bubble collecting chambers 12 can be prevented from being increased, and accordingly the inks are prevented from leaking from the recording heads 10.

(3) In the case where the air pressure in each of the air-bubble collecting chambers 12 is designed to be lower than the atmospheric pressure and respective water heads of each of the recording heads 10 and a corresponding one of the ink tanks are designed to be different from each other, if each of the opening and closing valves 19 is opened in a state in which the air pressure in the air-tight space 46 is equal to the atmospheric pressure, then the air in the space 46 flows into the corresponding air-bubble collecting chamber 12 and increases the air pressure therein, so that the ink flows back from the corresponding recording head 10 to the corresponding ink tank 5. However, in the present embodiment, the opening and closing valves 19 are opened after the air pressure in the air-tight space 46 has been lowered to be negative. Therefore, the air pressure in each of the air-bubble collecting chambers 12 is kept negative and accordingly the corresponding ink is prevented from flowing back into the corresponding ink tank 5.

(4) Each of the opening and closing valves 50 that extend through the thickness of the bottom wall of the air-discharge cap 40 has a bar-like shape, and the air-discharge cap 40 is formed of a silicone rubber. Therefore, the air-tight space 46 enjoys the sufficiently high air tightness, and the resistance produced when the each opening and closing valve 50 slides relative to the air-discharge cap 40 is sufficiently low.

(5) In the case where the air bubbles are discharged in a state in which the recording heads 10 directly communicate with the atmosphere, if the air pressure in each of the air-bubble collecting chambers 12 is lowered, then the meniscus of the ink formed in each of the nozzles of the recording heads 10 may be broken. However, in the present embodiment, the air bubbles are discharged in the state in which the nozzle cap 60 is held in close contact with the carriage 3 and accordingly the recording heads 10 are shut off from the atmosphere. Therefore, the meniscus of the ink formed in the each nozzle can be prevented from being broken.

(6) In the present embodiment, the plurality of recording heads 10 for the black and color inks are employed. In the case where a plurality of recording heads are employed, those recording heads may have different numbers of ink-ejection nozzles, may have respective ink-ejection nozzles having different diameters, or may correspond to respective ink-flow passages having different diameters or different lengths, and accordingly may correspond to respective air discharging passages that discharge the air bubbles from the air-bubble collecting chambers 12 to the discharge outlets 18 and have different resistances to flow of air therethrough. In this case, if the air bubbles are discharged concurrently through the plurality of air-discharge passages having the different air-flow resistances, respective amounts of air that are discharged from the air-bubble collecting chambers 12 may differ from each other. However, in the present embodiment, the pump 38 is operated, at different times, to discharge the air bubbles through the air-discharge passage corresponding to the black-ink-related recording head 10 and discharge the air bubbles through the three air-discharge passages corresponding to the three color-ink-related recording heads 10. Therefore, even if different amounts of air may be discharged from the plurality of air-bubble collecting chambers 12, it does not raise any problems.

(7) In the present embodiment, the three recording heads 10 for the three color inks have the same numbers of ink-ejection nozzles, have the respective ink-ejection nozzles having the same diameters, and correspond to the respective ink-flow passages having the same diameters and the same lengths, and accordingly correspond to the respective air-discharge passages that discharge the air bubbles from the air-bubble collecting chambers 12 to the discharge outlets 18 and have the same resistances to flow of air therethrough. Since, in the present embodiment, the air bubbles are discharged concurrently through the respective air-discharge passages having the same air-flow resistances, the same amounts of air can be efficiently discharged from the plurality of air-bubble collecting chambers 12.

(8) In the present embodiment, the switching member 73 that can switch the air-tight space 46 to its communication state in which the space 46 communicates with the pump 38 and to its shut-off state in which the space 46 is shut off from the pump 38, is displaced as a unit with the cam 55 that can move the opening and closing members 50 to their valve opening states in which the members 50 open the opening and closing valves 19 and to their valve closing states in which the members 50 close the opening and closing valves 19. Therefore, the operation for displacing the cam 55 to move the opening and closing members 50 and thereby open and close the opening and closing valves 19, and the operation for displacing the switching member 73 and thereby sucking, with the pump 38, the air bubbles can be performed at respective accurate timings. That is, no means is needed for synchronizing the movement of the opening and closing members 50 with the suction of the air bubbles. Therefore, the construction of the maintenance unit 4 can be simplified.

(9) In the discharged-ink sucking step in connection with the air-discharge cap 40, the gap is temporarily formed between the carriage 3 and one of the lengthwise opposite end portions of the cap 40 that is opposite to the suction hole 47, so that air flows from the gap toward the suction hole 47. Therefore, the inks that have been discharged with the air bubbles from the discharging passages 17 into the air-discharge cap 40 can be efficiently sucked and removed.

In addition, the rotations of the air-discharge-cap holder 48 (in particular, the rotation of the same 48 about a vertical axis line) other than the rotation of the same 48 about the axis portions 48*b* are inhibited by the abutment of the base portions 48*c* on the pairs of ribs 41*c*, as shown in FIGS. 12 and 18. Therefore, the above-described inclination of the air-discharge cap 40 can be easily performed.

(10) In the present embodiment, the supporting device that supports the air-discharge cap 40 such that the cap 40 can be inclined as described above, is constituted by the two projecting portions 48*a* projecting from the opposite ends of the air-discharge-cap holder 48 that are opposite to each other in the direction in which the opening and closing members 50 are arranged, and the two hook portions 49 that are provided in the lift member 41 and have the respective fitting holes 49*a* that engage the respective projecting portions 48*a*. Therefore, the supporting device that supports the air-discharge cap 40 can enjoy a simple and reliable construction.

(11) In the present embodiment, the opening and closing members 50 are moved, from their valve closing positions to close the opening and closing valves 19, in the direction intersecting the direction of movement of the carriage 3, and are advanced to their valve opening positions to open the opening and closing valves 19, while the opening and closing members 50 are inserted into the discharging passages 17. Therefore, if the carriage 3 would be moved to the origin position (i.e., the maintenance position) in a state in which the opening and closing members 50 are positioned at their valve opening positions, then the carriage 3 would collide with the members 50. However, in the present embodiment, when the carriage 3 is positioned in the recording area 8 in which the recording heads 10 record an image on a recording medium, the opening and closing members 50 are held at their valve closing positions; and if the carriage 3 is moved to the origin position where the air bubbles are discharged, then the opening and closing members 50 are allowed to advance to their valve opening positions. Thus, the carriage 3 can be prevented from interfering with the opening and closing members 50 being positioned at their valve opening positions.

(12) In the present embodiment, when the carriage 3 is moved from the recording area 8 to the origin position, the carriage 3 moves, by pushing, the air-discharge cap 40 from its waiting position to its close-contact position. Therefore, even if no means may be employed for synchronizing the movement of the carriage 3 with the movement of the air-discharge cap 40, the movement of the carriage 3 to the origin position, i.e., the maintenance position causes the air-discharge cap 40 to be brought into close contact with the carriage 3 at an appropriate timing. In addition, since the carriage 3 moves, by pushing, the air-discharge cap 40, no exclusive drive source is needed for moving the cap 40.

(13) In the present embodiment, when the carriage 3 is moved from the recording area 8 to the origin position, the carriage 3 moves, by pushing, the nozzle cap 60 from its waiting position to its close-contact position. Therefore, even if no means may be employed for synchronizing the movement of the carriage 3 with the movement of the nozzle cap 60, the movement of the carriage 3 to the origin position, i.e., the maintenance position causes the nozzle cap 60 to be brought into close contact with the carriage 3 at an appropriate timing. In addition, since the carriage 3 moves, by pushing, the nozzle cap 60, no exclusive drive source is needed for moving the cap 60.

(14) In the present embodiment, the cam 55 is driven or rotated by the gears 31, 32, 35 that are engaged with a drive device that drives or rotates the sheet-supply roller (not shown) so as to supply each recording sheet. That is, the cam 55 and the drive device are driven by the electric motor 23 as the common drive source. Therefore, the construction of the ink-jet printer can be simplified.

Other Embodiments

While the present invention has been described in its preferred embodiment, it is to be understood that the present invention may otherwise be embodied.

For example, in the above-illustrated embodiment, the air-discharge cap 40 is inclined by utilizing the two fitting holes 49*a* formed at the different height positions. However, the air-discharge cap 40 may be inclined by utilizing two projecting portions 48*a* that are formed at different height positions.

Figure 21A:
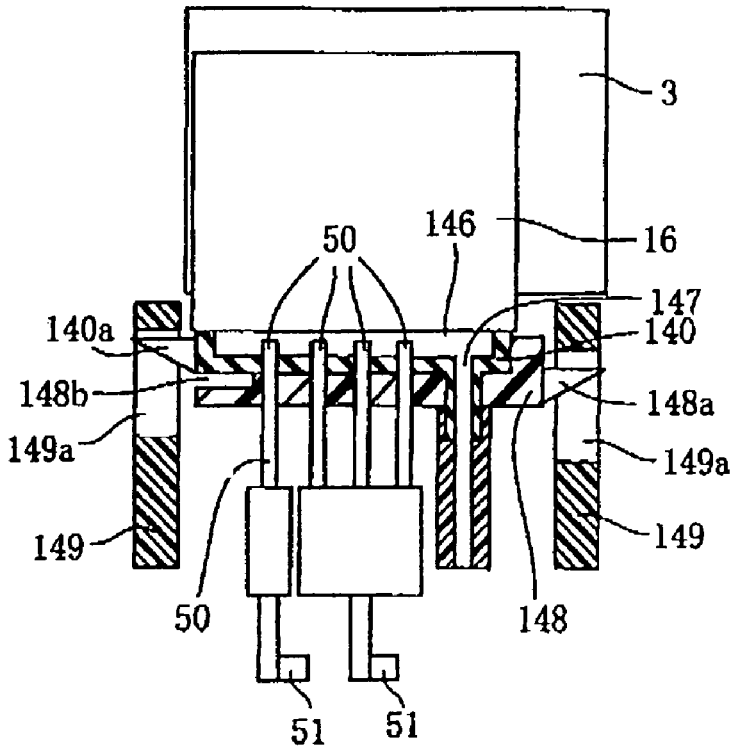
FIGS. 21A and 21B are illustrative views corresponding to FIGS. 14A and 14B, for explaining a manner in which another supporting device employed in another embodiment operates.
Figure 21B:
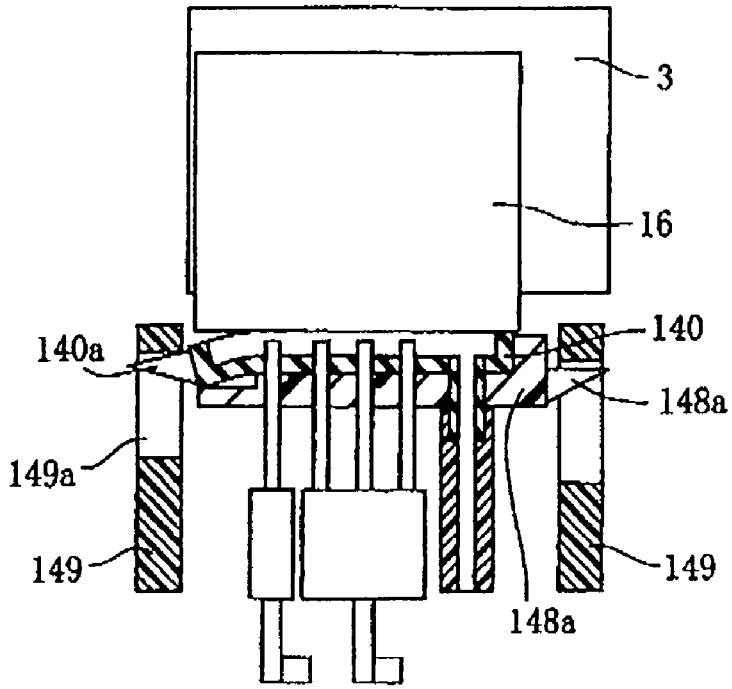

FIGS. 21A and 21B show a second embodiment of the present invention. The second embodiment differs from the first embodiment shown in FIGS. 1 through 20, in that the two extending portions 49 of the lift member 41 are replaced with two extending portions 149, the air-discharge cap 40 is replaced with an air-discharge cap 140, the air-discharge-cap holder 48 is replaced with an air-discharge-cap holder 148. In the second embodiment, the two extending portions 149 have respective fitting holes 149*a* that have respective upper ends at different height position. The air-discharge cap 140 is formed of an elastically deformable material such as a rubber, and has a suction hole 147 formed in a rear end portion of a bottom wall thereof and a first projecting portion 140*a* projecting from a front end surface of a side wall thereof. The air-discharge-cap holder 148 is formed of a rigid material such as a resin, and has a second projecting portion 148*a* projecting from a rear end surface of a side wall thereof, and a recess 148*b* formed in a front end portion of a bottom wall thereof. The air-discharge cap 140 and the air-discharge-cap holder 148 cooperate with each other to constitute an air-tight-space defining device that is biased upward by the two pushing-up springs 45 (FIG. 1). In a state, shown in FIG. 21A, in which an upper end surface of the side wall of the air-discharge cap 140 is entirely contacted with the lower surface of the bubble case 16 as a portion of the carriage 3, an air-tight space 146 is defined by the upper end surface of the side wall of the air-discharge cap 140 and the lower surface of the bubble case 16. In this state, the first and second projecting portions 140*a*, 148*a* are positioned away from the respective upper ends of the two fitting holes, 149*a*. If the lift member 41 (or the two extending portions 149 thereof is moved from its close-contact position shown in FIG. 21A, to its waiting position shown in FIG. 21B, the first projecting portion 140*a* of the air-discharge cap 140 is pushed down by the upper end of the corresponding fitting hole 149*a* in a state in which the second projecting portion 148*a* of the air-discharge-cap holder 148 is not engaged with the upper end of the other fitting hole 149*a*, Consequently the respective front end portions of the side wall and the bottom wall of the air-discharge cap 140 are elastically deformed downward since the recess 148*b* is formed in an upper surface of the bottom wall of the air-discharge-cap holder 148. Thus, a gap as an air flow inlet is formed between the air-discharge cap 140 and the carriage 3. When the pump 38 is driven, air flows in a direction from the gap toward the suction hole 147, so that the inks remaining in the cap 140 are effectively sucked by the pump 38 via the suction hole 147. Therefore, the second embodiment enjoys the same advantages as the above-described advantages of the first embodiment.

Figure 22A:
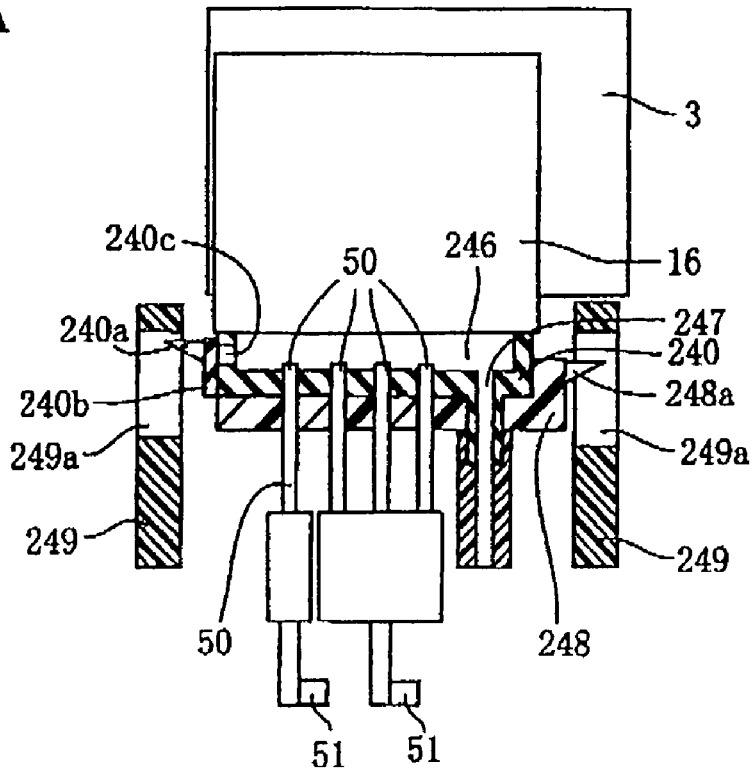
FIGS. 22A and 22B are illustrative views corresponding to FIGS. 14A and 14B, for explaining a manner in which another supporting device employed in another embodiment operates.
Figure 22B:
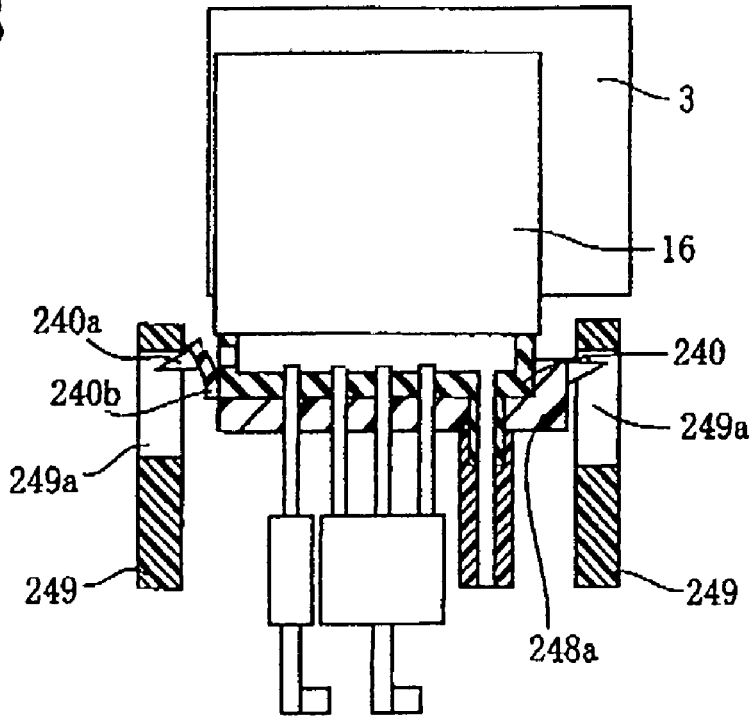

FIGS. 22A and 22B show a third embodiment of the present invention. The third embodiment differs from the first embodiment shown in FIGS. 1 through 20, in that the two extending portions 49 of the lift member 41 are replaced with two extending portions 249, the air-discharge cap 40 is replaced with an air-discharge cap 240, the air-discharge-cap holder 48 is replaced with an air-discharge-cap holder 248. In the third embodiment, the two extending portions 249 have respective fitting holes 249*a* that have respective upper ends at different height position. The air-discharge cap 240, an opening and closing valve 240*b* a lower portion of which is fixed to a front surface of a front end portion of a side wall of the air-discharge cap 240, and a first projecting portion 240*a* projecting from a front surface of the opening and closing valve 240*b* are all formed of an elastically deformable material such as a rubber, and the air-discharge cap 240 has a suction hole 247 formed in a rear end portion of a bottom wall thereof. The air-discharge cap 240 additionally has an ink flow inlet 240*c* that is formed through a thickness of the front end portion of the side wall thereof and is normally closed by a rear surface of the opening and closing valve 240*b*. The air-discharge-cap holder 248 is formed of a rigid material such as a resin, and has a second projecting portion 248*a* projecting from a rear end surface of a side wall thereof. The air-discharge cap 240 and the air-discharge-cap holder 248 cooperate with each other to constitute an air-tight-space defining device that is biased upward by the two pushing-up springs 45 (FIG. 1). In a state, shown in FIG. 22A, in which an upper end surface of the side wall of the air-discharge cap 240 is entirely contacted with the lower surface of the bubble case 16 as a portion of the carriage 3, an air-tight space 246 is defined by the upper end surface of the side wall of the air-discharge cap 240 and the lower surface of the bubble case 16. In this state, the first and second projecting portions 240*a*, 248*a* are positioned away from the respective upper ends of the two fitting holes 249*a*. If the lift member 41 (or the two extending portions 249 thereof is moved from its close-contact position shown in FIG. 22A, to its waiting position shown in FIG. 22B, the first projecting portion 240*a* projecting from the opening and closing valve 240*b* is pushed down by the upper end of the corresponding fitting hole 249*a* in a state in which the second projecting portion 248*a* of the air-discharge-cap holder 248 is not engaged with the upper end of the other fitting hole 249*a*. Consequently the opening and closing valve 240*b* is elastically deformed to open the air flow inlet 240*c*. In this state, if the pump 38 is driven, air flows in a direction from the air flow inlet 240*c* toward the suction hole 247, so that the inks remaining in the cap 240 are effectively sucked by the pump 38 via the suction hole 247. Therefore, the third embodiment enjoys the same advantages as the above-described advantages of the first embodiment. In the third embodiment, the first projecting portion 240*a*, the corresponding fitting hole 249*a*, the pushing-up springs 45, the links 42, the returning spring (not shown), and the carriage 3 cooperate with each other to constitute a valve controller which controls the opening and closing valve 240*b* to open and close the air flow inlet 240*c*.

It is to be understood that the present invention may be embodied with various changes, modifications, and improvements that may occur to a person skilled in the art without departing from the spirit and scope of the invention defined in the appended claims.

What is claimed is:

1. An ink jet printer, comprising:

a housing;

a plurality of recording heads each of which has at least one nozzle opening in a lower surface thereof and ejects, from said at least one nozzle, droplets of ink so as to record an image on a recording medium;

a carriage which is movable in the housing and which carries the plurality of recording heads;

a plurality of ink tanks which store at least one sort of ink to be supplied to the plurality of recording heads;

a plurality of ink flow passages which supply said at least one sort of ink from the plurality of ink tanks to the plurality of recording heads, respectively;

a plurality of air collecting chambers which are provided on the carriage and each of which collects air bubbles produced in a corresponding one of the plurality of ink flow passages;

a plurality of discharging passages which are provided on the carriage and each of which communicates with a corresponding one of the plurality of air collecting chambers;

a plurality of first opening and closing valves each of which is normally closed and is provided in a corresponding one of the plurality of discharging passages such that the plurality of first opening and closing valves are arranged in a first direction;

a plurality of opening and closing bars which are supported by the housing such that the plurality of opening and closing bars are arranged in a second direction parallel to the first direction, and each of which opens and closes a corresponding one of the plurality of first opening and closing valves;

an air-tight-space defining device including an air-discharge cap which has a bottom wall, a side wall projecting upward from a periphery of the bottom wall, and a suction hole, wherein the air-tight-space defining device is supported by the housing such that said each of the opening and closing bars air-tightly extends through a thickness of the bottom wall of the air-discharge cap and is movable relative to the air-discharge cap, and such that an upper end surface of the side wall of the air-discharge cap is closely contactable with a lower surface of the carriage to cover respective openings of the plurality of discharging passages and define an air-tight space communicating with each of the respective openings;

a suction device which sucks air through the suction hole of the air-discharge cap; and an air-flow generating device which causes an air flow inlet of the air-discharge cap to open at a position distant from the suction hole in a third direction having a first component parallel to the bottom wall of the air-discharge cap, so that when the suction device sucks the air through the suction hole, the air flows from the air flow inlet toward the suction hole in a fourth direction having a second component opposite to the first component of the third direction.

2. The ink jet printer according to claim 1, wherein the suction hole is formed in one of opposite end portions of the bottom wall of the air-discharge cap, and wherein the air-flow generating device comprises a separating device which separates, from the lower surface of the carriage, at least a distant portion of the upper end surface of the side wall of the air-discharge cap that corresponds to an other of the opposite end portions of the bottom wall.

3. The ink jet printer according to claim 2, wherein the separating device comprises an inclining device which inclines an entirety of the air-discharge cap relative to the lower surface of the carriage, so as to separate, from the lower surface of the carriage, the distant portion of the upper end surface of the side wall of the air-discharge cap.

4. The ink jet printer according to claim 2, wherein the separating device separates, from the lower surface of the carriage, the distant portion of the upper end surface of the side wall of the air-discharge cap and does not separate, from the lower surface of the carriage, at least a portion of the upper end surface of the side wall that corresponds to said one of the opposite end portions of the bottom wall.

5. The ink-jet printer according to claim 1, wherein the air-flow generating device comprises:

the air flow inlet which is formed through the side wall of the air-discharge cap;

a second opening and closing valve which opens and closes the air flow inlet; and a valve controller which controls the second opening and closing valve to open and close the air flow inlet.

6. The inkjet printer according to claim 1, wherein the air-flow generating device comprises:

at least one first engaging portion which is supported by a side wall of the air-tight-space defining device;

a biasing device which biases the air-tight-space defining device toward the carriage;

at least one second engaging portion which is engaged with said at least one first engaging portion such that the air-tight-space defining device is movable relative to said at least one second engaging portion; and a moving device which moves said at least one second engaging portion toward, and away from, the carriage.

7. The ink-jet printer according to claim 6, wherein said at least one first engaging portion comprises at least one projecting portion which projects from the side wall of the air-tight-space defining device, and wherein said at least one second engaging portion comprises at least one hook portion which has at least one fitting hole in which said at least one projecting portion fits such that the air-tight-space defining device is movable relative to said at least one hook portion, within a range corresponding to a dimension of said at least one fitting hole.

8. The ink-jet printer according to claim 7, comprising two said projecting portions which respectively project from the opposite end surfaces of the side wall of the air-tight-space defining device, and two said hook portions which have respective fitting holes in which said two projecting portions fit, respectively, wherein the fitting hole of each of the two hook portions has opposite ends a first end of which is nearer to the carriage than a second end of the opposite ends, and the air-discharge cap includes two opposite end portions which are opposite to each other in the second direction, wherein in a state in which the two projecting portions fit in the respective fitting holes of the two hook portions, such that the two projecting portions are engaged with the respective first ends of the respective fitting holes of the two hook portions, the air-tight-space defining device is inclined relative to the lower surface of the carriage such that one of the two opposite end portions of the air-discharge cap is more distant from the lower surface of the carriage than an other of said two opposite end portions, and wherein the air-discharge cap has, in said other end portion thereof, the suction hole through which the ink present in the air-discharge cap is sucked.

9. The ink-jet printer according to claim 6, wherein the biasing device comprises at least one spring.

10. The ink jet printer according to claim 6, comprising a pair of said first engaging portions which are respectively supported by opposite end surfaces of the side wall of the air-tight-space defining device that are opposite to each other in the second direction, and a pair of said second engaging portions which are engaged with the pair of first engaging portions, respectively.

11. The inkjet printer according to claim 9, wherein the biasing device comprises two said springs which are arranged in the second direction and cooperate with each other to bias the air-tight-space defining device toward the carriage.

12. The inkjet printer according to claim 10, wherein each of the two engaging portions of one pair of (A) the pair of first engaging portions and (B) the pair of second engaging portions has opposite ends a first end of which is nearer to the carriage than a second end of the opposite ends, and the air-discharge cap includes two opposite end portions which are opposite to each other in the second direction, wherein in a state in which the two engaging portions of an other pair of (A) the pair of first engaging portions and (B) the pair of second engaging portions are engaged with the respective first ends of the engaging portions of said one pair, the air-tight-space defining device is inclined relative to the lower surface of the carriage such that one of the two opposite end portions of the air-discharge cap is more distant from the lower surface of the carriage than an other of said two opposite end portions, and wherein the air-discharge cap has, in said other end portion thereof, the suction hole through which the ink present in the air-discharge cap is sucked.

13. The ink jet printer according to claim 12, wherein the air-tight-space defining device includes two axis portions about which the air-tight-space defining device is inclined relative to the lower surface of the carriage, and wherein the ink-jet printer further comprises two guide portions which guide the two axis portions, respectively.

14. The ink-jet printer according to claim 13, wherein the air-tight-space defining device further includes two base portions each of which is provided in a vicinity of a corresponding one of the two axis portions, and wherein the ink-jet printer further comprises two pairs of ribs which are provided such that the two ribs of each pair of the two pairs are located on either side of a corresponding one of the two guide portions, and are held in contact with a corresponding one of the two base portions, so that the two ribs cooperate with each other to prevent the air-tight-space defining device from rotating about an axis line intersecting a common axis line of the two axis portions.

15. The ink jet printer according to claim 1, further comprising a controller which controls the suction device to suck the air through the suction hole of the air-discharge cap in a first state in which the air-tight space is defined by the air-discharge cap and the lower surface of the carriage, and at least one of the first opening and closing valves is opened by a corresponding one of the opening and closing bars, and which controls the suction device to suck, through the suction hole, the ink present in the air-discharge cap in a second state in which the air flow inlet is caused to open by the air-flow generating device.

16. A method of sucking at least one sort of ink from an air-discharge cap of an ink-jet printer, the ink jet printer additionally including a housing; a plurality of recording heads each of which has at least one nozzle and ejects, from said at least one nozzle, droplets of said at least one sort of ink; a carriage which is movable relative to the housing and which carries the plurality of recording heads; a plurality of ink tanks which stores said at least one sort of ink to be supplied to the plurality of recording heads; a plurality of ink flow passages which supply said at least one sort of ink from the plurality of ink tanks to the plurality of recording heads, respectively; a plurality of air collecting chambers which are provided on the carriage and each of which collects air bubbles produced in a corresponding one of the plurality of ink flow passages; a plurality of discharging passages which are provided on the carriage and each of which communicates with a corresponding one of the plurality of air collecting chambers; a plurality of opening and closing valves each of which is normally closed and is provided in a corresponding one of the plurality of discharging passages; and a plurality of opening and closing bars which are supported by the housing such that each of the opening and closing bars air-tightly extends through a thickness of the air-discharge cap, and each of which opens and closes a corresponding one of the plurality of opening and closing valves, the air-discharge cap being supported by the housing such that the air-discharge cap is closely contactable with the carriage to cover respective openings of the plurality of discharging passages and define an air-tight space communicating with each of the respective openings, the method comprising:

operating, in a state in which the air-tight space is defined, at least one of the opening and closing bars to open at least corresponding one of the opening and closing valves and thereby discharge air from at least corresponding one of the air collecting chambers into the air-discharge cap via at least corresponding one of the discharging passages, while causing said at least one sort of ink to be discharged from at least corresponding one of the ink flow passages into the air-discharge cap via said at least one air collecting chamber and said at least one discharging passage, inclining, from said state in which the air-tight space is defined, the air-discharge cap relative to the carriage to form a gap between the carriage and a first portion of the air-discharge cap, and sucking, from a second portion of the air-discharge cap that is opposite to the first portion thereof, said at least one sort of ink discharged into the air-discharge cap, while causing air to flow in an air-flow direction from said gap toward the second portion and thereby convey the ink in the air-flow direction.

17. The method according to claim 16, further comprising:

providing the plurality of opening and closing valves which are arranged in a first direction, and the plurality of opening and closing bars which are arranged in a second direction which is parallel to the first direction and in which the first and second portions of the air-discharge cap are arranged, wherein the inclining comprises separating the first portion of the air-discharge cap from the carriage by a first distance larger than a second distance between the second portion of the air-discharge cap and the carriage.

18. The method according to claim 17, wherein the second distance is substantially zero.

19. The method according to claim 16, further comprising:

providing the inkjet printer which further includes a biasing device which applies a biasing force to the air-discharge cap in a biasing direction toward the carriage; and a moving device which applies, against the biasing force of the biasing device, a moving force to the air-discharge cap in a moving direction away from the carriage, wherein the inclining comprises separating, by utilizing the biasing force of the biasing device and the moving force of the moving device, the first portion of the air-discharge cap from the carriage and thereby inclining the air-discharge cap relative to the carriage.

* * * * *